US006146494A

United States Patent [19]

Seger et al.

[11] Patent Number: 6,146,494

[45] Date of Patent: Nov. 14, 2000

[54] MODIFIED CELLULOSIC FIBERS AND FIBROUS WEBS CONTAINING THESE FIBERS

[75] Inventors: Geoffrey Eugene Seger, Cincinnati; Larry Neil Mackey, Fairfield; Paul Dennis Trokhan, Hamilton, all of Ohio

[73] Assignee: The Procter & Gamble Company, Cincinnati, Ohio

[21] Appl. No.: 09/087,037

[22] Filed: May 29, 1998

Related U.S. Application Data

[60] Provisional application No. 60/049,457, Jun. 12, 1997.

[51] Int. Cl.[7] ..... D21H 11/20

[52] U.S. Cl. ..... 162/9; 162/72; 162/100; 162/111; 162/158; 162/182

[58] Field of Search ..... 162/72, 100, 9, 162/111, 158, 182

[56] References Cited

U.S. PATENT DOCUMENTS

| | | | |
|---|---|---|---|
| 3,406,089 | 10/1968 | Yerkes, Jr. | 162/199 |
| 3,616,222 | 10/1971 | Dasinger | 195/31 |
| 4,300,981 | 11/1981 | Carstens | 162/109 |
| 4,432,833 | 2/1984 | Breese | 162/158 |
| 4,923,565 | 5/1990 | Fuentes et al. | 162/72 |
| 4,976,819 | 12/1990 | Minton | 162/9 |
| 5,116,474 | 5/1992 | Fuentes et al. | 162/71 |
| 5,308,449 | 5/1994 | Fuentes et al. | 162/72 |
| 5,525,193 | 6/1996 | Frans et al. | 162/5 |
| 5,582,681 | 12/1996 | Back et al. | 162/5 |
| 5,620,565 | 4/1997 | Lazorisak et al. | 162/72 |

FOREIGN PATENT DOCUMENTS

| | | | |
|---|---|---|---|
| 1 191 727 | 8/1985 | Canada | D21H 5/00 |
| 5-148794 | 6/1993 | Japan | D21H 11/00 |
| 7-279078A | 10/1995 | Japan . | |
| 7-331588 | 12/1995 | Japan | D21D 1/20 |
| WO 91/17243 | 11/1991 | WIPO | C12N 9/42 |
| WO 94/07998 | 4/1994 | WIPO | C12N 9/42 |
| WO 95/24471 | 9/1995 | WIPO | C12N 9/42 |
| WO 95/26398 | 10/1995 | WIPO | C12N 9/42 |
| WO 95/27825 | 10/1995 | WIPO | D21H 21/14 |
| WO 95/33883 | 12/1995 | WIPO | D21C 9/10 |
| WO 96/00811 | 1/1996 | WIPO | D21C 5/00 |
| WO 96/04424 | 2/1996 | WIPO | D21H 15/02 |
| WO 96/11262 | 4/1996 | WIPO | C12N 9/42 |
| WO 96/19570 | 6/1996 | WIPO | C12N 9/42 |
| WO 96/28606 | 9/1996 | WIPO | D21C 9/00 |
| WO 97/04170 | 2/1997 | WIPO | D21H 21/22 |
| WO 97/04171 | 2/1997 | WIPO | D21H 23/02 |
| WO 97/04173 | 2/1997 | WIPO | D21H 27/00 |
| WO 97/27363 | 7/1997 | WIPO | D21H 11/20 |

OTHER PUBLICATIONS

Bhat, G.R., et al., "Novel Techniques for Enhancing the Strength of Secondary Fiber", Tappi Journal, (Sep. 1991) pp. 151–157.

Clark, T.A., et al., "Effects of Enzymatic Modification on Radiata Pine Kraft Fibre Wall Chemistry and Physical Properties", Appita (1996), pp. 49–53.

Cochaux, A., et al., "Fundamental Differences Between Beating and Cellulasic Actions on Softwood Kraft Fibres", Rev. Atip, vol. 50, No. 2, (Apr. 1996), pp. 49–55.

Jackson, L.S., et al., "Enzymatic Modifications of Secondary Fiber", Tappi Journal, vol. 76, No. 3 (Mar. 1993), pp. 147–154.

Kibblewhite, R.P. et al., "Enzymatic Modification of Radiata Pine Kraft Fibre and Handsheet Properties", Appita (1996), pp. 65–76.

Mansfield, S.D., et al., "Modification of Dougl Mechanical and Kraft Pulps by Enzyme Treatment", Tappi Journal, vol. 79, No. 8 (Aug. 1996), pp. 125–132.

Mansfield, S. D., et al., "Improving Paper Properties by a Selective Enzymatic Treatment of Coarse Pulp Fibres", 7$^{th}$ International Conference on Pulp and Paper Industry, Oral Presentations, vol. A, pp. A189–A192 (Jun. 1998).

Page, D.H., "A Theory for the Tensile Strength of Paper", Tappi, vol. 52, No. 4, (Apr. 1969) pp. 674–681.

Pere, J., et al., "Effects of Purified *Trichoderma reesei* Cellulases on the Fiber Properties of Kraft Pulp", Tappi Journal, vol. 78, No. 6 (Jun. 1995), pp. 71–78.

Stork, G. et al., "Studies on Improving Wastepaper Quality Through Enzymatic Treatment", Abstract #3234(AST), Abipst, vol. 67, No. 3 (Sep. 1996) p. 341.

Stork, G., et al., "Upgrading of Recycled Pulps by Enzymatic Treatment", Tappi Proceedings, 1994 Recycling Symposium, pp. 107–117.

Yamaguchi, H., et al., "Fiber", Appita (1996), pp. 91–98.

Novozym 342® Product Sheet, Enzyme Process Division, Novo Nordisk, Denmark.

Celluclast 1.5L® Product Sheet, Enzyme Process Divison, Novo Nordisk, Denmark.

Celluzyme® Product Sheet, Enzyme Business, Novo Nordisk, Denmark.

*Primary Examiner*—Peter Chin

*Attorney, Agent, or Firm*—Donald E. Hasse; Carl J. Roof; Edward J. Milbrada

[57] ABSTRACT

Disclosed are modified cellulosic fibers having a dry zero span tensile index that is substantially less than the dry zero span tensile index of the corresponding unmodified cellulosic fibers. Fibers having reduced dry zero span tensile may provide fibrous structures having improved hand feel compared with fibers prepared from unmodified fibers. In particular, such modified fibers provide fibrous structures with improved flexibility, which is perceived as improved softness. The reduced dry zero span tensile is preferably achieved by reacting the fibers with one or more cellulase enzymes and one or more debonders. The invention also relates to a fibrous structure having a density of not more than about 0.4 g/cc, wherein the fibrous structure comprises modified cellulosic fibers having a dry zero span tensile index that is at least about 15% less than the dry zero span tensile index of the corresponding unmodified cellulosic fibers; and wherein the fibrous structure has a bending modulus per unit dry tensile that is at least about 30% less than the bending modulus per unit dry tensile of a fibrous structure prepared from corresponding unmodified fibers.

64 Claims, No Drawings

MODIFIED CELLULOSIC FIBERS AND FIBROUS WEBS CONTAINING THESE FIBERS

CROSS REFERENCE TO RELATED APPLICATION

This application claims the benefit of U.S. Provisional Application No. 60/049,457 filed Jun. 12, 1997.

FIELD OF THE INVENTION

The present invention relates to fibrous structures useful in disposable products such as paper towels, facial tissue, toilet tissue, and the like. These fibrous structures provide improved hand feel/softness without sacrificing wet/dry tensile strength.

BACKGROUND OF THE INVENTION

Cellulosic fibrous structures, such as paper, are well known in the art. Such fibrous structures are in common use today for paper towels, toilet tissue, facial tissue, etc. To meet the needs of the consumer, these fibrous structures must balance several competing interests. For example, the fibrous structure must have sufficient tensile strength to prevent the fibrous structure from tearing or shredding during ordinary use or when relatively small tensile forces are applied. The cellulosic fibrous structure must also be absorbent, so that liquids may be quickly absorbed and fully retained by the cellulosic fibrous structure. The cellulosic fibrous structure should also exhibit sufficient softness, so that it is tactilely pleasant and not harsh during use. Against this backdrop of competing interests, the fibrous structure must be economical, so that it can be manufactured and sold for a profit, and yet still be affordable to the consumer.

Tensile strength, one of the aforementioned properties, is the ability of the fibrous structure to retain its physical integrity during use. As discussed by D. H. Page, "A Theory for the Tensile Strength of Paper", TAPPI, Vol 52(4), p. 674–82 (1969), tensile strength is controlled by two primary factors: fiber zero span tensile strength and fiber-fiber bonding (affected by, e.g., fiber sheer strength, relative bonded area, fiber length, fiber cross sectional area, and the average perimeter of the fiber cross section). With tissue and towel products and the like, the fiber zero span tensile strengths are generally on the order of at least 10 times greater than the overall tensile strength of the sheet. This in turn indicates that factors which influence fiber to fiber (i.e., interfiber) bonding control the tensile strength of the web and that the zero span strength of the fiber (i.e., intrafiber strength) can be reduced without adversely affecting overall product strength.

Softness is the ability of a fibrous structure to impart a particularly desirable tactile sensation to the user's skin. In general, softness is inversely proportional to the ability of the fibrous structure to resist deformation in a direction normal to the plane of the structure. Softness is influenced by bulk, surface texture (crepe frequency, size of various regions and smoothness), the stick-slip surface coefficient of friction, and bending stiffness or drape (also referred as hand feel). One or more of these properties can be affected by fiber flexibility, fiber morphology, bond density, unsupported fiber length, and the like.

Not surprisingly, significant effort has been expended to enhance the tensile strength (wet and/or dry) of fibrous substrates; the patent literature is reflective of this effort. Examples of prior art means for increasing tensile strength are addition of chemical wet and dry strength agents, binder fibers such as bi-component fibers, latex binders, and the like. Similarly, significant effort has been expended to provide substrates having improved hand feel, or softness. Examples include addition of chemical softeners, surface modifying agent, debonding agents, and the like. Other examples include mechanical treatment such as creping, Clupak®, Micrex®, wet microcontraction, and the like.

It is generally accepted that the strength of a fibrous substrate (typically measured in terms of wet and/or dry tensile strength) and that substrate's softness are dependently related, at least to some degree. That is, efforts directed at enhancing substrate softness typically will result in a reduction in substrate strength. Indeed, many prior attempts to improve substrate softness have focused on modifying (reducing) fiber-to-fiber bonds via chemical and/or mechanical treatments such as creping. While softness benefits are achieved, a reduction in interfiber bonding gives rise to a reduction in substrate tensile strength and an increase in product lintiness. Thus, there is a continuing need for a means to decouple the relationship between substrate softness and strength. In particular, there is a need for fibrous products having improved hand feel without sacrificing web strength.

Accordingly, it is an object of the present invention to provide a fibrous web, comprising cellulose-based fibers, which exhibits improved softness without negatively impacting strength to a significant degree. This is achieved by preparing the webs using modified cellulosic fibers that have reduced zero span tensile strength (i.e., reduced intrafiber strength), as opposed to reducing the level of interfiber bonding (i.e., interfiber strength) of the web. More specifically, Applicants have discovered that a measurable reduction in the dry zero span tensile of fibers typically provides a fibrous structure that exhibits improved flexibility (as measured in terms of a reduction in "bending modulus per unit dry tensile"). While a reduction in dry zero span tensile strength does not always provide improvements in structure flexibility, such a reduction is believed necessary to achieve more flexible structures in accordance with the present invention.

It is a further object of the present invention to provide the above-described modified cellulosic fibers, as well as a process for obtaining the modified cellulosic fibers.

SUMMARY OF THE INVENTION

In one aspect, the present invention relates to modified cellulosic fibers having a dry zero span tensile index that is at least about 35% less than the dry zero span tensile (also referred to hereafter as "DZST") index of the corresponding unmodified cellulosic fibers.

In another aspect, the invention relates to a fibrous structure having a density of not more than about 0.4 g/cc, wherein the fibrous structure comprises modified cellulosic fibers having a dry zero span tensile index that is at least about 15% less than the dry zero span tensile index of the corresponding unmodified cellulosic fibers; and wherein the fibrous structure has a bending modulus per unit dry tensile that is at least about 30% less than the bending modulus per unit dry tensile of a fibrous structure prepared from corresponding unmodified fibers. Preferably, the modified fibers that form such a fibrous structure, when formed into a handsheet consisting only of those modified fibers, will have a dry tensile (also referred to hereafter as "DT") index that is at least as great as the dry tensile index of a handsheet made from the corresponding unmodified fibers.

The terms dry tensile index, dry zero span tensile index, and bending modulus per unit dry tensile, and methods for determining these parameters, are described in detail below. Briefly, the dry tensile index of a fibrous web corresponds to the strength of the composite. In contrast, the dry zero span tensile index, though measured on a fibrous substrate, is a comparative measure of the intrinsic strength of individual fibers that make up that dry web. Although wet zero span tensile is generally recognized as a measure of intrinsic fiber strength, Applicants believe the dry zero span tensile value is more predictive of the relative fiber and web flexibility, and therefor softness, of a substrate formed from the fibers. Bending modulus per unit dry tensile is a measure of the stiffness per unit caliper and tensile of the fibrous structure in question.

As discussed above, prior attempts to improve web softness have typically resulted in decreased web tensile strength due to decreased fiber-to-fiber bonding. In contrast, the fibrous structures of the present invention comprise fibers that are sufficiently weak intrinsically to deliver flexibility and softness when formed into a dry web, but maintain the level of interfiber bonding to provide equal or greater overall web tensile strength.

In another aspect, the present invention relates to a method for preparing modified cellulosic fibers, the method comprising combining one or more cellulase enzymes and cellulosic fibers and allowing the combination to react for a period sufficient to reduce the dry zero span of the fibers by at least about 15% compared with the dry zero span of the corresponding unmodified fibers. In one preferred embodiment, a debonder or chemical softener is utilized in processing of the modified fibers.

DETAILED DESCRIPTION OF THE INVENTION

I. Definitions

As used herein, the term "dry tensile index" means the tensile strength of a fibrous structure, as measured in accordance with TAPPI standards T220 om-88 and T494 om-88 using an electronic tensile tester as described in the Test Methods, divided by the sample basis weight (sample weight per unit area).

As used herein, the term "dry zero span tensile index" means the tensile strength of dry individual fibers that form a fibrous structure, as measured using a combination electronic/compressed air tester as described in the Test Methods section, divided by the sample basis weight (sample weight per unit area). While the measurement of zero span tensile index utilizes a fibrous substrate as the test sample, it is accepted that the resulting tensile index is a relative measure of fiber intrinsic strength. This is achieved by providing essentially zero gap between the jaws of the tester, as compared to a gap of 4 inches in the dry tensile strength test.

As used herein, the term "wet zero span tensile index" means the intrinsic strength of wet fibers that form a fibrous structure, as measured using a combination electronic/compressed air tester as described in the Test Methods section.

As used herein, the term "bending modulus per unit dry tensile ratio" refers to the stiffness of a fibrous structure per unit tensile, as described in the Test Methods section.

The dry and wet zero span tensile index measurements, as well as bending modulus per unit dry tensile, are made on low density handsheet structures produced in accordance with the description set forth in the Test Method section.

As used herein, the term "modified fibers" means fibers that have been modified pursuant to the present invention, such that the dry zero span tensile index is reduced by the indicated percentage (e.g., at least 15%, at least 35%, etc.) relative to the starting fibers. As used herein, the term "unmodified fibers" refers to fibers that may have been processed via one or more operations commonly practiced in the industry, such as pulping, bleaching, refining, frotopulping, and the like, but have not been modified in accordance with the teachings of the present specification.

As used herein, the term "softwood" means wood derived from coniferous trees.

II. Modified Fibers and Fibrous Structures

In one aspect, the present invention relates to modified cellulosic fibers having a dry zero span tensile index that is at least about 35% less than, preferably at least about 40% less than, still more preferably at least about 45% less than, still more preferably at least about 50% less than, still more preferably at least about 55% less than, the dry zero span tensile index of the corresponding unmodified cellulosic fibers. Typically, the DZST index of the modified fibers will be from about 35 to about 65% less than the DZST of the corresponding unmodified fibers. In another aspect, the invention relates to modified cellulosic fibers having a wet zero span tensile (also referred to hereafter as "WZST") index that is at least about 70% less than, preferably at least about 75% less than, the wet zero span tensile index of the corresponding unmodified cellulosic fibers. In still another aspect, the invention relates to modified cellulosic fibers that exhibit a ratio of dry zero span tensile index to wet zero span tensile index of from about 1.5 to about 3, typically from about 1.7 to about 3, more typically from about 2 to about 3. In still another aspect, the present invention relates to a fibrous structure having a density of not more than about 0.4 g/cc, preferably from about 0.04 g/cc to about 0.4 g/cc, more preferably from about 0.05 to about 0.3 g/cc, wherein the fibrous structure comprises modified cellulosic fibers having a dry zero span tensile index that is at least about 15% less than the dry zero span tensile index of the corresponding unmodified fibers; and wherein the fibrous structure has a bending modulus per unit dry tensile that is at least about 30%, preferably at least about 35%, more preferably at least about 40%, less than the bending modulus per unit dry tensile of a fibrous structure prepared from corresponding unmodified fibers. For purposes of the present invention, density is measured on a dry fibrous structure and is calculated as the air dried basis weight of the structure divided by the thickness or caliper of the structure. Air dried basis weight and caliper are measured in a conditioned room where the temperature is 73° F.±4° F. (22.8° C.±2.2° C.) and the relative humidity is 50%±10%. The structure's caliper is measured according to TAPPI Test Method T 411 om-89, with the modification that the test foot of the caliper tester exerts a pressure of 0.2 psi. Preferably, the fibrous structure comprises modified cellulosic fibers that have a dry zero span tensile index that is at least about 20% less than, more preferably at least about 25% less than, still more preferably at least about 30% less than, still more preferably at least about 35% less than, the dry zero span tensile index of the corresponding unmodified cellulosic fibers.

It is understood that the density ranges described herein refer to the density of the fibrous structure in its final form (i.e., including any binders, strength agents, additives, softeners, surface modifying agent, debonding agents, and the like, as well as mechanical treatments such as wet and dry creping, wet and dry microcontraction, and the like). In contrast, the zero span tensile index, dry tensile index, and bending modulus per unit dry tensile measurements are all made on low density handsheets comprising fibers (modified or unmodified) only, as described in the Test Method section below.

With regard to fibrous structures, such structures will preferably comprise modified fibers that, when those modified fibers are formed into a handsheet comprising only fibers (i.e., no additive, etc.), have a dry tensile (also referred to hereafter as "DT") index that is at least as great as the dry tensile index of a handsheet made from the corresponding unmodified fibers. As used herein, the term "at least as great" means the handsheet comprising the modified fibers has a dry tensile index that is at least about 90% of the dry tensile index of a similar (in terms of density, basis weight, etc.) handsheet prepared from the unmodified fibers. Even more preferred is where the handsheet formed from the modified fibers has a dry tensile index that is greater than a handsheet made from the corresponding unmodified fibers, for example at least about 5%, more preferably at least about 15%, greater in terms of dry tensile index.

Applicants have discovered that a measurable reduction in the dry zero span tensile of fibers typically provides a fibrous structure that exhibits improved flexibility (as measured in terms of a reduction in "bending modulus per unit dry tensile") and softness. While a reduction in dry zero span reduction does not always provide improvements in structure flexibility, such a reduction is believed necessary to achieve more flexible structures in accordance with the present invention. In particular, Applicants have discovered that enzymatic treatment of fibers provides fiber morphologies that result in increased flexibility. While not wishing to be bound by theory, it is believed that this increased fiber flexibility is related to the reduced dry zero span tensile values. Furthermore, because the ability of the modified fibers to bond to one another has not been reduced significantly, the tensile strength of webs formed from these fibers is not adversely impacted to the expected degree. Indeed, Applicants have found that web tensile strength may actually increase relative to webs formed from corresponding untreated fibers. Thus, in a preferred embodiment of the present invention, in addition to the dry zero span tensile and bending modulus properties discussed above, fibrous substrates prepared from these modified fibers will have a dry tensile index of about the same or greater than the dry tensile index of a web made from corresponding untreated fibers.

A. Fibers for Modification

Fibers of diverse natural origin are applicable to the invention, so long as they are susceptible to enzymatic activity. Digested cellulose fibers from softwood (derived from coniferous trees), hardwood (derived from deciduous trees), cotton, or cotton linters may be utilized. Fibers from Esparto grass, bagasse, hemp, flax, and other lignaceous and cellulose fiber sources may also be utilized as raw material in the invention. The optimum source of the starting fibers will depend upon the particular end use contemplated. Generally wood pulps will be utilized. Wood pulps useful herein include both sulfite and sulfate pulps, as well as mechanical, thermo-mechanical, and chemi-thermo-mechanical pulps, derived from virgin or recycled fibrous sources, all of which are well known to those skilled in the papermaking art. Preferred wood pulps include chemical pulps such as northern, southern and tropical softwood Krafts (i.e., sulfate); northern, southern and tropical hardwood Krafts, including eucalyptus (such as *Eucalyptus grandis, Eucalyptus saligna, Eucalyptus urophilia, Eucalyptus globulus*); sulfite pulps (including northern, southern and tropical hardwoods and softwoods); and the like. Completely bleached, partially bleached and unbleached fibers are applicable. It may frequently be desired to utilize bleached pulp for its superior brightness and consumer appeal. Also useful in the present invention are fibers derived from recycled paper, which can contain any or all of the above categories as well as other non-fibrous materials such as fillers and adhesives used to facilitate the original paper making.

The paper products formed from the modified fibers of the present invention may also contain non-cellulose fibrous material, for example, glass fibers and synthetic polymeric fibers. Synthetic polymeric fibers useful herein include polyolefins, particularly polyethylenes, polypropylene and copolymers having at least one olefinic constituent. Other materials such as polyesters, nylons, copolymers thereof and combinations of any of the foregoing may also be suitable as the fibrous polymeric material. Mixtures of any of the foregoing fibers may be used.

B. Enzymes

It is recognized that upon reading Applicants' specification, any of the known cellulase enzymes and/or cellulase enzyme preparations (which may include other enzymes, such as hemicellulases, pectinases, amylases, etc.) may be utilized to carry out the present invention. Of the cellulases, several endoglucanases and exoglucanases are known and can be used, separately or in combination, according to the present invention. The enzymes should be active and stable at the conditions, especially pH and temperature, that prevail during the pulp treatment processes. Representative examples of suitable enzymes are those derived from the microorganisms listed on Table A and Table B.

TABLE A

| Examples of cellulase-producing fungi |
|---|
| *Agaricus bisporus* |
| *Ascoboulus furfuraceus* |
| *Aspergillus aculeatus, A. fumigatus, A. niger, A. phoenicis, A. terreus* and *A. wentii* |
| *Botryodiploida theobromae* |
| *Chaetomium cellulolytlicum, C. globosum* and *C. thermophile* |
| *Chrysosporium lignorum* |
| *Cladosporium cladosporioides* |
| *Coriolus versicolor* |
| *Dichomitus squalens* |
| *Eupenicillium javanicum* |
| *Fomes famentarium* |
| *Fusarium moniliforme, F solani* and Fusarium spp. |
| *Humicola grisea* and *H. insolens* |
| *Hypocapra merdaria* |
| *Irpex lacteus* |
| *Lenzites trabea* |
| *Mycellophtora thermophila* |
| *Myriococcum albomyces* |
| *Myrothecium verrucarla* |
| *Neocallimastix frontalis* |
| *Neurospora crassa* |
| *Paecilomyces fusisporus* and *P. variotly* |
| *Papulaspora thermophilia* |
| *Pellicularia filamentosa* |
| *Penicillium chrysogenum, P. citrioviride, P. funicolosum, P. notatum, P. pinophilium, P. variabile* and *P. verruculosum* |
| *Pestalotiopsis versicolor* |
| *Phanerochaete chrysosporium* |
| *Phialophora malorum* |
| *Phoma hibernica* |
| *Physarum polycephalum* |
| *Pleurotus ostreatus* and *P. sajor-caju* |
| *Podospora deciplens* |
| *Polyporus schweinitzil* and *P. versicolor* |
| *Poria placenta* |
| *Poronia punctata* |
| *Pyricularia orzyzae* |
| *Saccobolus trunctatus* |
| *Schizophyllum commune* |
| *Sclerotinia libertiana* |
| *Sclerotium rolfsii* |

TABLE A-continued

| Examples of cellulase-producing fungi |
|---|
| *Scytalidium lignicola* |
| *Sordaria fimicola* |
| *Sporotrichum pulverulentum* and *S. thermophile* |
| *Stereum sanguinolentum* |
| *Talaromyces emersonii* |
| *Thermoascus aurantiacus* |
| *Thrausiotheca clavata* |
| *Torula thermophile* |
| *Trichoderma koningii, T. pseudokoningii* and *T. reesei* |
| *Trichurus spiralis* |
| *Verticillium albo-atrum* |
| *Volvariella volvacea* |

TABLE B

| Examples of cellulase-producing bacteria[1] |
|---|
| *Cellulomonas flavigena, C. biazotea, C. cellasea, C. fimi, C. gelida, C.* curtae, C. uda and *C. turbata* |
| *Bacillus brevis, B. firmus, B. lichenformis, B. pumilus, B. subtilis, B.* polymyxa and *B. cereus* |
| *Serrata marcescens* |
| '*Pseudomonas fluorescens* var. *cellulosa*' |
| '*Cellvibrio viridus, C. flavescens, C. ochraceus, C. fulvus, C. vulgaris* and *C. gilvus*' |
| *Cytophaga hutchinsonii, C. aurantiaca, C. rubra, C. tenulssima, C. winogradskii* and *C. krzemieniewskoe* |
| *Herpetosiphon geysericolus* |
| *Sprorcytophaga myxococcoides* |
| *Streptomyces flavogriseus* |
| 'Thermoactinomyces sp.' |
| *Thermomonospora curvata* |

[1]The bacteria within prime signs are not validly classified.

The fungi and bacteria listed above are only given as examples. Presently microorganisms which are strains of Humicola (e.g., *H. insolens*) and Trichoderma (e.g., *T. reesei*) are considered particularly suitable for the production of the enzymes useful herein, but the scope of the present invention is not limited to the use of the named microorganisms. It is very possible that other enzyme-producing microorganisms suitable for the present invention already exist or will be developed using mutation and selection or methods of genetic engineering. It is also likely, that the enzyme producing capabilities of an existing microorganism can be further enhanced through genetic engineering.

A preferred cellulase enzyme useful herein is Celluclast®, an enzyme sold by Enzyme Process Division, Bioindustrial Group, Novo Nordisk A/S, Bagsvaerd, Denmark. Celluclast® is derived from the fungus *Trichoderma reesei*. Celluclast® 1.5 L is a liquid cellulase preparation having an activity of 1500 NCU/g. Activity is determined on the basis of Novo Cellulase Units (or "NCUs"). One NCU is the amount of enzyme which degrades carboxy methylcellulose to reducing carbohydrates with a reduction power corresponding to $1\times10^{-6}$ mol glucose per minute, at standard conditions of 40° C., pH 4.8, and a reaction time of 20 minutes. A more detailed description of the activity measurement is outlined in Novo Nordisk Analytical Method No. AF 187.2 (available from Novo Nordisk).

Another preferred cellulase preparation useful herein is Celluzyme®, sold by Enzyme Process Division, Bioindustrial Group, Novo Nordisk A/S, Bagsvaerd, Denmark. Celluzyme® 0.7T is a granular cellulase preparation that has an enzyme activity of approximately 700 CEVU/g and is derived from *Humicola insolens*. The activity is determined on the basis of Cellulase Viscosity Units (CEVU) under specified conditions outlined in World Patent Publication No. WO 91/17243, published Nov. 14, 1991 by Rasmussen et. al (the disclosure of which is incorporated herein by reference) and Novo Nordisk Analytical Method No. AF 253 (available from Novo Nordisk).

Still another preferred cellulase preparation useful herein is Pergolase®, sold by Ciba, Greensboro, N.C. The Pergolase® A40 used is a liquid cellulase preparation that has an active protein content of approximately 140 g/L as measured by the Lowrey Method and is derived from *Trichoderma reesei*. Pergolase® A40 is a mixture of endo- and exocellulases, xylanases and mannanases.

Still another preferred cellulase chosen for economic reasons is a product sold under the trademark Carezyme® by Novo Nordisk A/S. Carezyme® 5.0 L is a liquid cellulase preparation that has an enzyme activity of approximately 5,000 CEVU/g. The activity is determined on the basis of Cellulase Viscosity Units (CEVU) under specified conditions outlined in World Patent Publication No. WO 91/17243, published Nov. 14, 1991 by Rasmussen et. al and Novo Nordisk Analytical Method No. AF 253. Carezyme® is composed primarily of the family 45 endoglucanase, EG V (~43,000 kD molecular weight) or homologues thereof, derived from *Humicola insolens* as described in WO 91/17243. Variants of the family 45 endoglucanase found in Carezyme® are also described in World Patent Publication No. WO 94/07998, published Apr. 14, 1994 by M. Schulein, et al. (the disclosure of which is incorporated herein by reference) and are believed to be useful in modifying fibers in accordance with the present invention. As used herein, a "family 45" enzyme is an enzyme as described in Henrissat, B. et. al, *Biochem. J.*, Vol. 293, p. 781–788 (1993), the disclosure of which is incorporated herein by reference.

It is generally accepted that the endoglucanase found in Carezyme® does not degrade highly crystalline cellulose, but degrades amorphous cellulose mainly to cellobiose, cellotriose and cellotetraose. Celluclast®, Celluzyme®, and Pergolase® on the other hand are combinations of endo and exoglucanases and/or hemicellulases. As shown in the examples below, acceptable reductions in dry zero span tensile are found with all enzyme preparations, which suggests that wide ranges of exo/endo cellulytic activity may be used to reduce dry zero span tensile according to the present invention.

It will be recognized that enzyme addition to fibers may occur via an isolated enzyme preparation. Alternatively, microorganisms which contain or produce cellulase or cellulose-degrading enzymes may be combined directly with the fibers for modification.

C. Preparing Modified Fibers and Corresponding Fibrous Structures i. Modified Fibers In general, enzyme treatment of fibers to obtain the modified fibers of the present invention is accomplished by adding a cellulase-containing enzymatic preparation to an aqueous slurry of fibers, and stirring the mixture for a period sufficient to allow action by the enzyme to modify the morphology of the fibers. After mixing of the fibers and enzyme preparation, the mixture is preferably, though not necessarily, combined with a debonder or chemical softener (referred to herein collectively as a "debonding agent") which is believed to preserve the fiber morphology modifications that result from enzymatic action. To obtain fibrous structures having the appropriate properties for desired end-uses such as paper towels, facial and toilet tissues, and the like, it is preferred that fiber length not be reduced to a significant degree during the modification process.

The skilled artisan will recognize that fiber treatment conditions may vary depending on, for example, the nature of the fiber being treated, the enzyme(s) being used, and the like. As such, the following description may be modified accordingly, depending on the specific materials being utilized.

In general, disintegrated pulp of the desired fibers is diluted with water to make a fibrous slurry prior to combining with the enzyme. The slurry preferably has a pulp consistency of at least about 0.5%, more preferably at least about 1%, still more preferably at least about 2%. As used herein, "pulp consistency" is the mass of the dry fibers divided by the total mass of the slurry. Preferably, the pulp consistency of the slurry will be not more than about 40%, to facilitate mixing of the enzyme and the slurry. Of course, higher consistency pulps may be utilized in practicing the present invention. In general, a separate enzyme solution is also prepared prior to combination with the fibers. The concentration of the enzyme solution may vary widely and will be determined by the relative activity of the enzymes utilized, the fibers being treated, the degree of dry zero span tensile reduction desired, the time and temperature of the reaction, and other related conditions.

The pH of the fibrous slurry/enzyme mixture is adjusted, if necessary, to the appropriate level for the enzyme employed. The pH adjustment, if necessary, can occur prior to, during, or after combining of the enzyme and the fibrous slurry. The pH of the resulting mixture may be controlled using various buffers or various acids or bases. In a particularly preferred embodiment using Carezyme® and/or Celluzyme®, a pH of from about 5 to about 9 is preferred. For other enzymes, such as Celluclast® and Pergolase®, a pH of about 4 to about 6 has been found to be more preferred. After combining the fibrous slurry, enzyme, and any optional pH adjustment, the mixture is reacted, preferably with agitation, for a period sufficient to reduce the fiber intrinsic strength in accordance with the present invention. The temperature of the mixture is preferably controlled between about 80 and 160° F., more preferably 100 and 140° F., still more preferably between about 120 and 140° F. Typically, the mixture will be reacted for a period of at least about 0.25 hours, more typically for at least about 0.5 hours, even more typically for at least about 1 hour. Typically the mixture will be reacted for a period of not more than about 4 hours, more typically not more than about 3 hours.

Again, the skilled artisan will recognize that different reaction conditions, concentrations, etc. may be required to achieve the desired fiber modification, depending on the fibers being treated, the enzyme(s) used, the reaction temperature, the reaction time, the degree of dry zero span tensile reduction desired, the type of agitation employed, and the like. The determination of how these variables may be adjusted is well within the level of the skilled artisan.

Applicants have found that while beneficial intrafiber weakening can be measured on the wet fibers after enzymatic reaction (i.e., reduced wet zero span tensile strength), a certain amount of the reduced fiber strength is lost on drying of the fibers (i.e., dry zero span tensile strength). (See Tables 1 through 9 below.) However, by adding a debonding agent to the wet enzyme-modified fibers, a further reduction in dry zero span tensile may be accomplished relative to fibers treated with enzyme alone. Applicants have also found that while certain debonding agents do not provide a significant reduction in DZST of the fibers, they do provide fibrous structures of improved flexibility without adversely impacting the structures' dry tensile strength. As such, in a particularly preferred embodiment, after the requisite reaction of the pulp slurry and the enzyme solution, a debonding agent is added to the mixture and is allowed to react, typically for at least about 30 seconds and preferably at least about 5 minutes and more preferably for at least about 30 minutes to about 60 minutes, with constant mixing. It will be recognized that the debonding agent may be added to the fibers before or during combination with the enzyme, so long as the debonding agent does not interfere with the activity of the enzyme utilized.

Any debonding agent (or softener) known in the art may be utilized in this preferred embodiment. Examples of useful agents are tertiary amines and derivatives thereof; amine oxides; quaternary amines; silicone-based compounds; saturated and unsaturated fatty acids and fatty acid salts; alkenyl succinic anhydrides; alkenyl succinic acids and corresponding alkenyl succinate salts; sorbitan mono-, di- and tri-esters, including but not limited to stearate, palmitate, oleate, myristate, and behenate sorbitan esters; and particulate debonders such as clay and silicate fillers. Useful debonding agents are described in, for example, U.S. Pat. No. 3,395,708 (issued Aug. 6, 1968 to Hervey et al.), U.S. Pat. No. 3,554,862 (issued Jan. 12, 1971 to Hervey et al.), U.S. Pat. No. 3,554,863 (issued Jan. 12, 1971 to Hervey et al.), U.S. Pat. No. 3,775,220 (issued Aug. 28, 1973 to Freimark et al.), U.S. Pat. No. 3,844,880 (issued Oct. 29, 1974 to Meisel et al.), U.S. Pat. No. 3,916,058 (issued Oct. 28, 1975 to Vossos et al.), U.S. Pat. No. 4,028,172 (issued Jun. 7, 1977 to Mazzarella et al.), U.S. Pat. No. 4,069,159 (issued Jan. 17, 1978 to Hayek), U.S. Pat. No. 4,144,122 (issued Mar. 13, 1979 to Emanuclsson et al.), U.S. Pat. No. 4,158,594 (issued Jun. 19, 1979 to Becker et al.), U.S. Pat. No. 4,255,294 (issued Mar. 10, 1981 to Rudy et al.), U.S. Pat. No. 4,314,001 (issued Feb. 2, 1982), U.S. Pat. No. 4,377,543 (issued Mar. 22, 1983 to Strohbeen et al.), U.S. Pat. No. 4,432,833 (issued Feb. 21, 1984 to Breese et al.), U.S. Pat. No. 4,776,965 (issued Oct. 11, 1988 to Nuesslein et al.), U.S. Pat. No. 4,795,530 (issued Jan. 3, 1989 to Soerens et al.), U.S. Pat. No. 4,937,008 (issued Jun. 26, 1990 to Yamamura et al.), U.S. Pat. No. 4,950,545 (issued Aug. 21, 1990 to Walter et al.), U.S. Pat. No. 5,026,489 (issued Jun. 25, 1991 to Snow et al.), U.S. Pat. No. 5,051,196 (issued Sep. 24, 1991 to Blumenkopf et al.), U.S. Pat. No. 5,529,665 (issued Jun. 25, 1996 to Kaun et al.), U.S. Pat. No. 5,552,020 (issued Sep. 3, 1996 to Smith et al.), U.S. Pat. No. 5,558,873 (issued Sep. 24, 1996 to Funk et al.), U.S. Pat. No. 5,580,566 (issued Dec. 3, 1996 to Syverson et al.), PCT Publication Nos. WO 97/01470 (published by Kryzysik on Feb. 6, 1997), WO 97/04171 (published by W. Schroeder et al. on Feb. 6, 1997), and WO 96/04424 (published by Vinson on Feb. 15, 1996), the disclosure of each of which is incorporated herein by reference. Preferred debonding agents for use herein are cationic materials such as quaternary ammonium compounds, imidazolinium compounds, and other such compounds with aliphatic, saturated or unsaturated carbon chains. The carbon chains may be unsubstituted or one or more of the chains may be substituted, e.g. with hydroxyl groups. Non-limiting examples of quaternary ammonium debonding agents useful herein include hexamethonium bromide, tetraethylammonium bromide, lauryl trimethylammonium chloride, and dihydrogenated tallow dimethylammonium methyl sulfate. Other preferred debonding agents for use herein to improve fibrous structure flexibility are alkenyl succinic acids, and their corresponding alkenyl succinate salts. Non-limiting examples of alkenyl succinic acid compounds are n-Octadecenylsuccinic acid and n-Dodecenylsuccinic acid and their corresponding succinate salts. Ion pairing of the alkenyl succinates with multivalent metal salts or cationic debonding agents is particulary useful at further reducing the bending modulus per unit dry tensile of the fibrous structure. While not wishing to be bound by theory, it is believed that the debonding agent maintains the fiber "damage" caused by the enzymatic attack on the fiber. That is, after the enzyme alters the morphology of the fiber, the debonding agent prevents the "repair" of the fiber, at least to some degree, that otherwise may take place upon drying. This in turn increases the flexibility of the resulting fibrous web while maintaining or improving the fiber to fiber bonding. In this regard, other materials that perform the same function may be used to enhance dry zero span tensile reduction and flexibility. The debonding agent will preferably be added at a level of at least about 0.1%, preferably at least about 0.2%, more preferably at least about 0.3%, on a dry fiber basis. Typically, the debonding agent will be added at a level of from about 0.1 to about 6%, more typically from about 0.2 to about 3%, active matter on dry fiber basis. The percentages given for the amount of debonding agent is given as an amount added to the fibers, not as an amount actually retained by the fibers.

Applicants have found that the degree of agitation during treatment of the fibers according to the present invention is also an important variable affecting the degree of dry zero span tensile reduction. While agitation is not necessarily required according to the present invention, in general, agitation increases the reduction in dry zero span tensile, other conditions being the same. Indeed, as shown in Example 1, and in particular Samples 1O and 1P, where treatment of a 10 to 13.3% consistency slurry carried out using a high intensity laboratory mixer provides fibers of lower dry zero span tensile than those obtained using low intensity shaft mixing (Sample 1E) of a lower consistency slurry, all other variables being the same. The high intensity laboratory mixer used in Example 1 is generally recognized to represent the mixing intensity found in medium consistency pumps and high shear mixers used in industrial practice. The skilled artisan will recognize that parameters affecting the degree of agitation include, but are not limited to, consistency of the mixture, mixing rate, and size and geometry of the reaction vessel and the mixing device.

ii. Fibrous Structures

After enzyme and preferred debonder treatment, the modified fibers are formed into a fibrous structure using any of the known methods for web manufacture. These fibrous structures can comprise any conventionally fashioned sheet or web having suitable basis weight, caliper (thickness), absorbency and strength characteristics suitable for the intended end use. A fibrous structure of the present invention can be generally defined as a bonded fibrous product in which the enzyme modified fibers are distributed randomly as in "air-laying" or certain "wet-laying" processes, or with a degree of orientation, as in certain "wet-laying" or "carding" processes. The fibers can optionally be bonded together with a polymeric binder resin.

Conventionally, fibrous structures of the present invention are made by wet-laying procedures. In such procedures, a web is made by forming an aqueous papermaking furnish comprising partially or all enzyme-modified fibers of the present invention, depositing this furnish onto a foraminous surface, such as a Fourdrinier wire, and by then removing water from the furnish, for example by gravity, by vacuum assisted drying and/or by evaporation, with or without pressing, to thereby form a fibrous structure of desired fiber consistency. In many cases, the papermaking apparatus is set up to rearrange the fibers in the slurry of the papermaking furnish as dewatering proceeds in order to form webs of especially desirable strength, hand, bulk, appearance, absorbency, etc.

The papermaking furnish utilized to form preferred fibrous structures essentially comprises an aqueous slurry of the modified fibers of the present invention and can optionally contain a wide variety of chemicals such as wet strength resins, surfactants, pH control agents, softness additives, debonding agents and the like.

A number of papermaking processes have been developed which utilize a papermaking apparatus that forms webs having particularly useful or desirable fiber configurations. Such configurations can serve to impart such characteristics of the paper web as enhanced bulk, absorbency and strength. One such process employs an imprinting fabric in the papermaking process that serves to impart a knuckle pattern of high density and low density zones into the resulting paper web. A process of this type, and the papermaking apparatus for carrying out this process, is described in greater detail in U.S. Pat. No. 3,301,746 (Sanford et. al), issued Jan. 31, 1967, which is incorporated by reference.

Another papermaking process carried out with a special papermaking apparatus is one that provides a paper web having a distinct, continuous network region formed by a plurality of "domes" dispersed throughout the network region on the substrate. Such domes are formed by compressing an embryonic web as formed during the papermaking process into a foraminous deflection member having a patterned network surface formed by a plurality of discrete isolated deflection conduits in the deflection member surface. A process of this type, and apparatus for carrying out such a process, is described in greater detail in U.S. Pat. No. 4,529,480 (Trokhan), issued Jul. 16, 1985, U.S. Pat. No. 4,637,859 (Trokhan), issued Jan. 20, 1987; and; U.S. Pat. No. 5,073,235 (Trokhan), issued Dec. 17, 1991; all of which are incorporated by reference. Another type of papermaking process, and apparatus to carry it out that is suitable for making layered composite paper substrates is described in U.S. Pat. No. 3,994,771 (Morgan et al.), issued Nov. 30, 1976, which is incorporated by reference.

Still another papermaking process that can utilize the fibers of the present invention is one that provides a paper web having a continuous high basis weight network region surrounding discrete low basis weight regions. The webs are formed using a forming belt having zones of differing flow resistances arranged in a particular ratio of flow resistances. In general, the basis weight of a given region is inversely proportional to the flow resistance of the corresponding zone of the forming belt. A process of this type, and apparatus for carrying out such a process, is described in greater detail in U.S. Pat. No. 5,245,025 (Trokhan et al.), issued Sep. 14, 1993; U.S. Pat. No. 5,503,715 (Trokhan et al.), issued Apr. 2, 1996; and U.S. Pat. No. 5,534,326 (Trokhan et al.), issued Jul. 9, 1996; the disclosure of each of which is incorporated herein by reference.

Yet another papermaking process that can utilize the fibers of the present invention is one that provides a layered paper web having a smooth, velutinous surface. The web is formed using relatively short fibers, where the top surface of the web is processed such that interfiber bonds are broken to provide free fiber ends that improve tactility. A process of this type is described in detail in U.S. Pat. No. 4,300,981 (Carstens), issued Nov. 17, 1981, the disclosure of which is incorporated by reference herein.

Another papermaking process employs a throughdrying fabric having impression knuckles raised above the plane of the fabric. These impressions create protrusions in the throughdried sheet, and provide the sheet with stretch in the cross-machine direction. A process of this type is described in European Patent Publication No. 677,612A2, published Oct. 18, 1995 by G. Wendt et al., the disclosure of which is incorporated herein by reference.

The preferred fibrous structures can form one of two or more plies that can be laminated together. Lamination, and lamination carried out in combination with an embossing procedure to form a plurality of protuberances in the laminated product, is described in greater detail in U.S. Pat. No. 3,414,459 (Wells), issued Dec. 3, 1968, which is incorporated by reference. These paper substrates preferably have a basis weight of between about 10 g/m$^2$ and about 65 g/m$^2$, and density of about 0.6 g/cc or less. More preferably, the basis weight will be about 40 g/m$^2$ or less and the density will be about 0.3 g/cc or less. Most preferably, the density will be between about 0.04 g/cc and about 0.2 g/cc. Unless otherwise specified, all amounts and weights relative to the paper web substrates are on a dry basis.)

In addition to the modified fibers of the present invention, the papermaking furnish used to make the fibrous structures can have other components or materials added thereto as can be or later become known in the art. The types of additives desirable will be dependent upon the particular end-use of the tissue sheet contemplated. For example, in products such as toilet paper, paper towels, facial tissues, baby wipes and other similar products, high wet strength is a desirable attribute. Thus, it is often desirable to add to the papermaking furnish chemical substances known in the art as "wet strength" resins.

A general dissertation on the types of wet strength resins utilized in the paper art can be found in TAPPI monograph series No. 29, Wet Strength in Paper and Paperboard, Technical Association of the Pulp and Paper Industry (New York, 1965). The most useful wet strength resins have generally been cationic in character. For permanent wet strength generation, polyamide-epichlorohydrin resins are cationic wet strength resins that have been found to be of particular utility. Suitable types of such resins are described in U.S. Pat. No. 3,700,623 (Keim), issued Oct. 24, 1972, and U.S. Pat. No. 3,772,076 (Keim), issued Nov. 13, 1973, both of which are incorporated by reference. One commercial source of a useful polyamide-epichlorohydrin resin is Hercules, Inc. of Wilmington, Del., which markets such resins under the mark Kymene® 557H.

Polyacrylamide resins have also been found to be of utility as wet strength resins. These resins are described in U.S. Pat. Nos. 3,556,932 (Coscia et al), issued Jan. 19, 1971, and 3,556,933 (Williams et al), issued Jan. 19, 1971, both of which are incorporated by reference. One commercial source of polyacrylamide resins is American Cyanamid Co. of Stamford, Conn., which markets one such resin under the mark Parez® 631 NC.

Still other water-soluble cationic resins finding utility wet strength resins are urea formaldehyde and melamine formaldehyde resins. The more common functional groups of these polyfunctional resins are nitrogen containing groups such as amino groups and methylol groups attached to nitrogen. Polyethylenimine type resins can also find utility in the present invention. In addition, temporary wet strength resins such as Caldas 10 (manufactured by Japan Carlit), CoBond 1000 (manufactured by National Starch and Chemical Company), and Parez 750 (manufactured by American Cyanamide Co.) can be used in the present invention. It is to be understood that the addition of chemical compounds such as the wet strength and temporary wet strength resins discussed above to the pulp furnish is optional and is not necessary for the practice of the present invention.

In addition to wet strength additives, it can also be desirable to include in the papermaking fibers certain dry strength and lint control additives known in the art. In this regard, starch binders have been found to be particularly suitable. In addition to reducing linting of the fibrous structure, low levels of starch binders also impart a modest improvement in the dry tensile strength without imparting stiffness that could result from the addition of high levels of starch. Typically the starch binder is included in an amount such that it is retained at a level of from about 0.01 to about 2%, preferably from about 0.1 to about 1%, by weight of the paper substrate.

In general, suitable starch binders for these fibrous structures are characterized by water solubility, and hydrophilicity. Although it is not intended to limit the scope of suitable starch binders, representative starch materials include corn starch and potato starch, with waxy corn starch known industrially as amioca starch being particularly preferred. Amioca starch differs from common corn starch in that it is entirely amylopectin, whereas common corn starch contains both amylopectin and amylose. Various unique characteristics of amioca starch are further described in "Amioca—The Starch From Waxy Corn," H. H. Schopmeyer, Food Industries, December 1945, pp. 106–108 (Vol. pp. 1476–1478).

The starch binder can be in granular or dispersed form, the granular form being especially preferred. The starch binder is preferably sufficiently cooked to induce swelling of the granules. More preferably, the starch granules are swollen, as by cooking, to a point just prior to dispersion of the starch granule. Such highly swollen starch granules shall be referred to as being "fully cooked." The conditions for dispersion in general can vary depending upon the size of the starch granules, the degree of crystallinity of the granules, and the amount of amylose present. Fully cooked amioca starch, for example, can be prepared by heating an aqueous slurry of about 4% consistency of starch granules at about 190° F. (about 88° C.) for between about 30 and about 40 minutes. Other exemplary starch binders that can be used include modified cationic starches such as those modified to have nitrogen containing groups, including amino groups and methylol groups attached to nitrogen, available from National Starch and Chemical Company, (Bridgewater, N.J.), that have previously been used as pulp furnish additives to increase wet and/or dry strength.

Use of other binders such as latexes, polyvinyl alcohol, thermoplastic binder fibers, and the like, may also be used in forming fibrous structures of the present invention.

III. Paper Products

The fibrous substrates of the present invention are particularly adapted for paper products, or components of paper products, which are to be disposed of after use. Accordingly, it is to be understood that the present invention is applicable to a variety of paper products including, but not limited to, disposable absorbent paper products such as those used for household, body, or other cleaning applications. Exemplary paper products thus include tissue paper including toilet tissue and facial tissue, paper towels, and core materials for absorbent articles such as feminine hygiene articles including sanitary napkins, pantiliners and tampons, diapers, adult incontinent articles and the like.

IV. Test Method Section—Sample Preparation

The following is a description of how fibrous structures are prepared from both modified (i.e., treated in accordance with the present invention) and unmodifed (i.e., untreated or control) fibers. These structures are then subjected to the physical tests (i.e., zero span tensile, dry tensile, and bending modulus per unit dry tensile) described in the succeeding Section.

Low Density Handsheets

Low Density handsheets are made essentially according to TAPPI standard T205, with the following modifications which are believed to more accurately reflect the tissue manufacturing process.

(1) tap water, with no pH adjustment, is used;

(2) the embryonic web is formed in a 12 in. by 12 in. handsheet making apparatus on a monofilament polyester wire supplied by Appelton Wire Co., Appelton, Wis. with the following specifications:

| | |
|---|---|
| Size: | 13.5 inch × 13.5 inch |
| Machine direction Warp Count: | 84 1.5 fibers/inch |
| Cross direction Warp Count: | 76 ± 3.0 fibers/inch |
| Warp size/type: | 0.17 millimeters/9FU |
| Shute size/type: | 0.17 millimeters/WP-110 |
| Caliper: | 0.016 ± 0.0005 inch |
| Air permeability: | 720 ± 25 cubic feet/minute |

(3) the embryonic web is transferred by vacuum from the monofilament polyester wire to a monofilament polyester papermaking fabric supplied by Appelton Wire Co., Appelton, Wis. and dewatered by vacuum suction instead of pressing; Fabric specifications:

| | |
|---|---|
| Size: | 16 inch × 14 inch |
| Machine direction Warp Count: | 36 ± 1 fibers/inch |
| Cross direction Warp Count: | 30 ± 3 fibers/inch |
| Warp size/type: | 0.40 millimeters/WP-87-12A-W |
| Shute size/type: | 0.40 millimeters/WP-801-12A-W |
| Caliper: | 0.0270 ± 0.001 inch |
| Air permeability: | 397 ± 25 cubic feet/minute |

Sheet side to be monoplane

Transfer and dewatering details: The embryonic web and papermaking wire are placed on top of the fabric such that the embryonic web contacts the fabric. The trilayer (wire, web, fabric with fabric side down) is then passed lengthwise across a 13 in.×1/16 in. wide vacuum slot box with a 90 degree flare set at a peak gauge reading of approximately 4.0 in. of mercury vacuum. The rate of the trilayer passing across the vacuum slot should be uniform at a velocity of 16±5 in./sec.

The vacuum is then increased to achieve a peak gauge reading of approximately 9 in. of mercury vacuum and the trilayer is passed lengthwise across the same vacuum slot at the same rate of 16±5 in./sec 2 more times. Note that the peak gauge reading is the amount of vacuum measured as the trilayer passes across the slot. The web is carefully removed from the wire to ensure that no fibers stick to the wire.

(4) the sheet is then dried on a rotary drum drier with a drying felt by passing the web and fabric between the felt and drum with the fabric against the drum surface and again with a second pass with the web against the drum surface.

| | |
|---|---|
| Dryer specifications: | Stainless steel polished finish cylinder with internal steam heating, horizontally mounted. |
| External dimensions: | 17 inches length × 13 inches diameter |
| Temperature: | 230 ± 5 degrees Fahrenheit. |
| Rotation speed: | 0.90 ± 0.05 revolutions/minute |

-continued

| | |
|---|---|
| Dryer felt: | Endless, 80 inches circumference by 16 inches wide, No. 11614, style X225, all wool. Noble and Wood Lab Machine Company, Hoosick Falls, NY. |
| Felt tension: | As low and even as possible without any slippage occurring between the felt and dryer drum and uniform tracking. |

(5) the resulting handsheet is 12 in.×12 in. with a resulting target basis weight of 16.5±1 pounds per 3,000 $ft^2$ and a target density of 0.15±0.06 g/cc, unless otherwise noted.

The dry 12 in.×12 in. handsheet of fibers is then conditioned prior to testing a minimum of 2 hours in a conditioned room where the temperature is 73° F.±4° F. (22.8° C.±2.2° C.) and the relative humidity is 50%±10%.

V. Test Method Section—Physical Tests

It will be recognized that the test methods described in this section require the making of handsheets following the specific procedure described above. Where a given product is in a form that includes chemical additives or where the fibrous structure is subjected to mechanical manipulation in generating the product, it is to be recognized that the determination of whether that product is within the scope of the present invention is made by forming handsheets in accordance with the present description, and measuring the physical properties of those handsheets, not measuring the physical properties of the product itself. That is, the fibers used to construct the product are used to make the handsheets as described; no application of additives or mechanical manipulation, aside from that discussed above, should occur. However, as discussed above, density measurements are made on final products which have been mechanically treated, include desired chemical additives, etc.

A. Dry Tensile Strength Index

This test is performed on 1 in. by 6 in. (about 2.5 cm×15.2 cm) strips of paper according to TAPPI standards T220 om-88 and T494 om-88 in a conditioned room where the temperature is 73° F.±4° F. (about 28° C.±2.2° C.) and the relative humidity is 50%±10%. An electronic tensile tester (Intellect II-STD, Thwing Albert Corp., Philadelphia, Pa.) is used and operated at a crosshead speed of 4 in. per minute (about 10 cm per min.) and a starting gauge length of 4 in. (about 10 cm). A minimum of n=8 tests are performed on each paper sample. The resulting tensile strength values recorded in g/in. are divided by the average basis weight of the sample and converted to achieve the corresponding tensile index values in N*m/g.

B. Dry Zero Span Tensile Index

This test is performed on 1 in. by 4 in. (about 2.5 cm×10.2 cm) strips of paper (including handsheets as described above, as well as other paper sheets) in a conditioned room where the temperature is 73° F.±4° F. (about 28° C.±2.2° C.) and the relative humidity is 50%±10%. A combination electronic/compressed air tester (Troubleshooter, Pulmac Instruments International, Montpelier, Vt.) is used and operated at an air supply pressure of 100 psi. The jaws of the tester are 15 mm in width and loaded to a clamping pressure of 80 psi. The pressure required to break the strip width of 15 mm with a beginning jaw separation of zero is recorded in units of psi. (If the pressure reading is below 9 psi, two plies of the handsheet material are combined and tested to obtain measurements within the capability of the instrument.) The pressure to break minus the zeroing pressure of the instrument is divided by the average basis weight of the sample and converted to obtain the dry zero span tensile index value in units of N*m/g. A minimum of n=8 tests are performed on each pulp sample.

C. Wet Zero Span Tensile Index

This test is performed similarly to the Dry Zero Span Tensile Strength procedure with the following modifications:

The dry 1 in.×4 in. strip of paper is inserted between two Wet Sample Insertors supplied with the instrument containing three notch cuts. The paper strip is wetted at the center notch cut with a squirt bottle filled with 73° F.±4° F. (about 28° C.±2.2° C.) distilled water via squirting a small amount of water next to the notch and allowing it to drain into the center notch (avoiding heavy spray pressure or touching the sample with the tip of the bottle). The sample and inserters are then set into the head of the unit with the notches lining up with the jaw teeth and the test is run as described above. The pressure to break minus the zeroing pressure of the instrument is divided by the average basis weight of the sample and converted to obtain the wet zero span tensile index value in units of N*m/g. A minimum of n=8 tests are performed on each pulp sample.

D. Bending Stiffness (Cantilever Bending Method)

This test is performed on 1 in. by 6 in. (about 2.5 cm×15.2 cm) strips of paper according to the description below in a conditioned room where the temperature is 73° F.±4° F. (about 28° C.±2.2° C.) and the relative humidity is 50%±10% for a minimum of 2 hours prior to testing. A Cantilever Bending Tester such as described in ASTM Standard D 1388 (Model 5010, Instrument Marketing Services, Fairfield, N.J.) can be used and operated at a ramp angle of 41.5±0.5° and a sample slide speed of 0.5±0.2 in. per second (about 1.3±0.5 cm per second). A minimum of n=16 tests are performed on each paper sample from n=8 sample strips.

i. Sample Preparation

From one handsheet, carefully cut four 1 in. wide strips of sample 6.0±0.1 inches in length in the "MD" direction. From a second handsheet of the same sample set, carefully cut four 1 in. wide strips of sample 6.0±0.1 inches in length in the "CD" direction. It is important that the cut be exactly perpendicular to the long dimension of the strip. The strip should also be free of wrinkles or excessive mechanical manipulation which can impact flexility. Mark the direction very lightly on one end, keeping the same surface of the sample up for all strips. Later, the strips will be turned over for testing, thus it is important that one surface of the strip be clearly identified, however, it makes no difference which surface of the sample is designated as the upper surface.

ii. Operation

The tester should be placed on a bench or table that is relatively free of vibration, excessive heat, and air drafts. Adjust the platform to horizontal as indicated by the leveling bubble and verify that the bend angle is at 41.5±0.5°.

Remove the sample slide bar from the top of the platform of the bending tester. Place one of the test sample strips on the horizontal platform using care to align the strip parallel with the movable slide. Align the sample exactly even with the vertical edge of the tester where the angular ramp is attached or where the zero mark line is scribed on the tester. Carefully place the sample slide back on top of the sample strip in the tester. The sample slide must be carefully placed so that the strip is not wrinkled or moved from its initial position.

Move the sample and sample slide at a rate of approximately of 0.5±0.2 in. per second (about 1.3±0.5 cm per second), toward the end of the tester to which the ramp is attached. This can be accomplished with either a manual or automatic tester. Ensure that no slippage between the sample and movable slide occurs. As the sample slide bar and sample strip project over the edge of the tester, the sample strip will begin to bend, or drape downward. Stop moving the sample slide bar the instant the leading edge of the sample strip falls level with the ramp edge. Read and record the overhang length from the linear scale to the nearest 0.5 millimeters. Record the distance the sample slide bar has moved in centimeters as overhang length.

The test sequence is performed on the face and back of each sample strip for a total of two readings per specimen. This in turn, gives a total of sixteen readings for each paper sample comprising 8 MD and 8 CD readings.

iii. Calculations

The average overhang length is determined by averaging the sixteen results obtained on the paper sample.

$$\text{Average Overhang Length} = \frac{\text{Sum of 16 results}}{16}$$

Bend length is calculated by dividing average overhang length by two.

$$\text{Bend Length} = \frac{\text{overhang length overall}}{2}$$

Flexural Rigidity

Calculate the flexural rigidity (G):

$$G=0.1629\times W\times C^3$$

where W is the sample basis weight in pounds/3000 sq. ft., and C is the bending length in cm. Results are expressed in milligram force*cm; the constant 0.1629 is used to convert the basis weight from English to metric units.

Bending Modulus

In general, the flexural rigidity (stiffness) is highly dependent on sample thickness (caliper). In order to compare samples of unequal caliper, Bending Modulus is used as the comparison means.

$$Q = \frac{G}{I}$$

Where G is the Flexural Rigidity of the sample (above) and I is the moment of inertia.

Using standard techniques for plate theory, the above equation may be manipulated to give the more useful relationship:

$$Q = \frac{G}{1/12\ t^3} = \frac{732\times G}{t^3}$$

where Q is the Bending Modulus in Kg-force/cm$^2$, G is the Flexural Rigidity (above in mg-force*cm) t is the sample thickness (caliper) in mils (1/1000 inch), and 732 is a conversion constant.

Bending Modulus/Dry Tensile Ratio

The sheet stiffness is also dependantly related to dry tensile strength of the fibrous structure. Since it is desirable to produce samples with lower stiffness without corresponding decreases in sheet strength, the ratio of Bending Modulus per unit dry tensile are reported. This enables samples of unequal tensile strength and caliper to be compared with a greater softness potential realized at a lower ratio. The relationship is shown below:

$$M = \frac{Q * 1000}{\text{dry tensile}}$$

Where M is the Bending Modulus/Dry tensile ratio in units of $1/cm^2$, Q is the Bending Modulus in Kg-force/$cm^2$ and dry tensile is in units of grams-force.

vi. Examples

A. Starting Fibers

Northern Softwood Kraft (NSK) pulp: Standard Reference Material 8495 Northern Softwood Bleached Kraft Pulp (U.S. Dept. of Commerce, National Institute of Standards and Technology, Gaithersburg, Md. 20899), drylap form.

Eucalyptus (Euc) pulp: Standard Reference Material 8496 Eucalyptus Hardwood Bleached Kraft Pulp (U.S. Dept. of Commerce, National Institute of Standards and Technology, Gaithersburg, Md. 20899), in drylap form.

Northern Hardwood Sulfite (NHS) pulp: Never dried, bleached, mixed hardwood acid bisulfite pulp (The Procter and Gamble Paper Products Company Mehoopany, Pa.). Totally Chlorine Free bleached via EOP bleaching to a 93.7, −0.5, 6.4 Hunter L, a, b, color.

Southern Softwood Kraft (SSK) pulp: Buckeye Cellulose Corporation Memphis, Tenn. type FF (Foley Fluff) fully bleached pulp comprised of Slash and Loblolly pine in drylap form.

B. Pulp Disintegration

After determining the pulp consistency, the above pulps are divided into multiple batches of approximately 30 grams bone dry fiber each and are diluted to 2,000 mL with room temperature distilled water. The fibers and water are then disintegrated for 50,000 revolutions in a TAPPI Standard Pulp Disintegrator (Model D-111, Testing Machines Incorporated, Islandia, N.Y.). After disintegration, the pulp slurry is quantitatively transferred and dewatered in a Buchner funnel with filter paper. The resulting pulp cake is peeled from the filter paper and the filter paper is rinsed over the cake to retain extraneous fiber. The pulp cake is then refrigerated until further testing outlined below for a maximum of one week.

C. Enzyme Preparation

Refrigerated, concentrated liquid enzyme is diluted to a 1 or 2% concentration (vol/vol) in an 80/20 mixture of distilled water and 1,2 propanediol and refrigerated until use: Carezyme® 5.0L or Celluclast® 1.5 L or Celluzyme® 0.7 T—all available from Novo Nordisk, Bagsvaerd, Denmark—or Pergolase A40, available from Ciba, Greensboro, N.C., are used.

Example 1

Treatment of NSK Fibers with Carezyme®

Northern Softwood Kraft (NSK) pulp cakes from section B above are treated and made into 18 low density handsheet samples (6 sheets per sample) using the procedure outlined above. The control NSK pulp is left unmodified and is diluted to 2,000 mL with tap water and disintegrated for 3,000 revolutions in a TAPPI Standard Desintigrator before handsheet making.

Sample 1A is an NSK Pulp Treated Without Enzymes:

The fibers are treated at approximately 3% consistency. Distilled water preheated to 120° F. is first mixed with 30 mL of a 1% hexamethonium bromide solution (1% wt active chemical/wt dry fiber basis) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the debonder/water mixture. The mixing rate of the Lightnin'® mixer is increased to achieve continuous turn over and agitation of the pulp slurry and allowed to react for approximately 1 hour. At the end of the hour, the pulp slurry is quantitatively transferred and rinsed with approximately 500 mL of distilled water and dewatered in a Buchner funnel with filter paper. The resulting pulp cake is then diluted to 2,000 mL with tap water and disintegrated for 3,000 revolutions in a TAPPI Standard Desintigrator before handsheet making.

Sample 1B is an NSK Pulp Treated Without Enzymes:

The fibers are treated at approximately 3% consistency. Distilled water preheated to 120° F. is first mixed with 90 mL of a 3% tetraethylammonium bromide solution (1% wt active chemical/wt dry fiber basis) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the debonder/water mixture. The mixing rate of the Lightnin'® mixer is increased to achieve continuous turn over and agitation of the pulp slurry and allowed to react for approximately 1 hour. At the end of the hour, the pulp slurry is quantitatively transferred and rinsed with approximately 500 mL of distilled water and dewatered in a Buchner funnel with filter paper. The resulting pulp cake is then diluted to 2,000 mL with tap water and disintegrated for 3,000 revolutions in a TAPPI Standard Desintigrator before handsheet making.

Sample 1C is an NSK Pulp Treated Without Enzymes:

The fibers are treated at approximately 3% consistency. Distilled water preheated to 120° F. is first mixed with 30 mL of a 1% lauryl trimethyl ammonium chloride (Sherex Chemical Co, Witco Corp., Greenwich, Conn.) (1% wt active chemical/wt dry fiber basis) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the debonder/water mixture. The mixing rate of the Lightnin'® mixer is increased to achieve continuous turn over and agitation of the pulp slurry and allowed to react for approximately 1 hour. At the end of the hour, the pulp slurry is quantitatively transferred and rinsed with approximately 500 mL of distilled water and dewatered in a Buchner funnel with filter paper. The resulting pulp cake is then diluted to 2,000 mL with tap water and disintegrated for 3,000 revolutions in a TAPPI Standard Desintigrator before handsheet making.

Sample 1D is an NSK Pulp Treated Without Enzymes:

The fibers are treated at approximately 3% consistency. Distilled water preheated to 120° F. is first mixed with 10 mL of a 3% N-decyl-N,N-dimethylamine oxide (Barlox® 10S -Lonza, Inc. Fairlawn, N.J.) (1% wt N-decyl-N,N-dimethylamine oxide/wt dry fiber basis) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the debonder/water mixture. The mixing rate of the Lightnin'® mixer is increased to achieve continuous turn over and agitation of the pulp slurry and allowed to react for approximately 1 hour. At the end of the hour, the pulp slurry is quantitatively transferred and rinsed with approximately 500 mL of distilled water and dewatered in a Buchner funnel with filter paper. The resulting pulp cake is then diluted to 2,000 mL with tap water and disintegrated for 3,000 revolutions in a TAPPI Standard Desintigrator before handsheet making.

Sample 1E is Made from NSK Pulp that is Modified by the Following Process:

The fibers are treated at approximately 3% consistency. Distilled water preheated to 120° F. is first mixed with 30 mL of a 1% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the hour, the pulp slurry is quantitatively transferred and dewatered in a Buchner funnel with filter paper. The modified pulp cake is then added to approximately 1,000 mL of a 100 ppm NaOCl (4 mL of Clorox®, available from The Clorox Co., Oakland, Calif.) in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 1F is Made from NSK Pulp that is Modified by the Following Process:

The fibers are treated at approximately 3% consistency. Distilled water preheated to 120° F. is first mixed with 60 mL of a 1% Carezyme® solution (2% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the hour, the pulp slurry is quantitatively transferred and dewatered in a Buchner funnel with filter paper. The modified pulp cake is then added to approximately 1,000 mL of a 100 ppm NaOCl (4 mL of Clorox in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 1G is Made from NSK Pulp that is Modified by the Following Process:

The fibers are treated at approximately 3% starting consistency. Distilled water preheated to 120° F. is first mixed with 30 mL of a 1% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the enzyme reaction period, 30 mL of a 1% (wt/vol) solution of hexamethonium bromide (Aldrich Chemical Company Milwaukee, Wis. catalogue No. 21,967-3) in distilled water is added to the enzyme/pulp slurry to achieve a 1% add-on level (wt active chemical/wt dry fiber basis) and allowed to continue mixing for a second hour at 120° F. At the end of the second hour, the slurry of modified fibers is made directly into low density handsheets without filtering, quenching or disintegration.

Sample 1H is Made from NSK Pulp that is Modified by the Following Process:

The fibers are treated at approximately 3% starting consistency. Distilled water preheated to 120° F. is first mixed with 60 mL of a 1% Carezyme® solution (2% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the enzyme reaction period, 30 mL of a 1% (wt/vol) solution of hexamethonium bromide (Aldrich Chemical Company Milwaukee, Wis. catalogue No. 21,967-3) in distilled water is added to the enzyme/pulp slurry to achieve a 1% add-on level (wt active chemical/wt dry fiber basis) and allowed to continue mixing for a second hour at 120° F. At the end of the second hour, the slurry of modified fibers is made directly into low density handsheets without filtering, quenching or disintegration.

Sample 1I is Made from NSK Pulp that is Modified by the Following Process:

The fibers are treated at approximately 3% starting consistency. Distilled water preheated to 120° F. is first mixed with 30 mL of a 1% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the enzyme reaction period, 30 mL of a 1% (wt/vol) solution of tetraethylammonium bromide (Aldrich Chemical Company Milwaukee, Wis. catalogue No. 14,002-3) in distilled water is added to the enzyme/pulp slurry to achieve a 1% add-on level (wt active chemical/wt dry fiber basis) and allowed to continue mixing for a second hour at 120° F. At the end of the second hour, the pulp slurry is quantitatively transferred and dewatered in a Buchner funnel with filter paper. The modified pulp cake is then added to approximately 1,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 1J is Made from NSK Pulp that is Modified by the Following Process:

The pulp cake is treated at approximately a 3% starting consistency. Distilled water preheated to 120° F. is first mixed with 30 mL of the 1% Carezyme® solution (1% volume/wt addition of Carezyme® 5.0 L on bone dry pulp) for approximately 15 seconds via a Lightnin' lab mixer (Lightnin', Rochester, N.Y.) in a 120° F. water bath. The unmodified pulp cake is preheated to approximately 120° F. via a microwave oven and is then added to the enzyme/water mixture. The mixing rate of the pulp/enzyme slurry is increased to achieve continuous turn over and agitation and allowed to react for approximately 1 hour. At the end of the enzyme reaction period, 30 mL of a 1% (wt/vol) solution of lauryl trimethyl ammonium chloride (Sherex Chemical Co, Witco Corp., Greenwich, Conn.) in distilled water is added to the enzyme/pulp slurry to achieve a 1% add-on level (wt active chemical/wt dry fiber basis) and allowed to continue mixing for a second hour at 120° F. At the end of the second hour, the pulp slurry is quantitatively transferred and dewatered in a Buchner fuinnel with filter paper. The modified pulp cake is then added to approximately 1,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 1K is Made from NSK Pulp that is Modified by the Following Process:

The pulp cake is treated at approximately a 3% starting consistency. Distilled water preheated to 120° F. is first mixed with 30 mL of the 1% Carezyme® solution (1% volume/wt addition of Carezyme® 5.0 L on bone dry pulp) for approximately 15 seconds via a Lightnin® lab mixer (Lightnin', Rochester, N.Y.) in a 120° F. water bath. The unmodified pulp cake is preheated to approximately 120° F. via a microwave oven and is then added to the enzyme/water mixture. The mixing rate of the pulp/enzyme slurry is increased to achieve continuous turn over and agitation and allowed to react for approximately 1 hour. At the end of the enzyme reaction period, 30 mL of a 1% (wt/vol) solution of triethanolamine (Dow Chemical Co, Midland Mich.) in distilled water is added to the enzyme/pulp slurry to achieve a 1% add-on level (wt active chemical/wt dry fiber basis) and allowed to continue mixing for a second hour at 120° F. At the end of the second hour, the pulp slurry is quantitatively transferred and dewatered in a Buchner funnel with filter paper. The modified pulp cake is then added to approximately 1,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 1L is Made from NSK Pulp that is Modified by the Following Process:

The pulp cake is treated at approximately a 3% starting consistency. Distilled water preheated to 120° F. is first mixed with 30 mL of the 1% Carezyme® solution (1% volume/wt addition of Carezyme® 5.0 L on bone dry pulp) for approximately 15 seconds via a Lightnin® lab mixer (Lightnin', Rochester, N.Y.) in a 120° F. water bath. The unmodified pulp cake is preheated to approximately 120° F. via a microwave oven and is then added to the enzyme/water mixture. The mixing rate of the pulp/enzyme slurry is increased to achieve continuous turn over and agitation and allowed to react for approximately 1 hour. At the end of the enzyme reaction period, the pH of the enzyme/pulp slurry is then adjusted to pH 7.5 with the addition of 0.01 N NaOH. 10 mL of a 3% (wt/vol) solution of N-decyl-N,N-dimethylamine oxide (Barlox® 10S-Lonza, Inc. Fairlawn, N.J.) in distilled water is added to the enzyme/pulp slurry to achieve a 1% add-on level (wt active chemical/wt dry fiber basis) and allowed to continue mixing for a second hour at 120° F. At the end of the second hour, the slurry of modified fibers is acidified to pH 3.8 with HCl. The modified pulp slurry is quantitatively transferred and rinsed with approximately 500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making Sample 1M is Made from NSK Pulp that is Modified by the Following Process:

The pulp cake is treated at approximately a 3% starting consistency. Distilled water preheated to 120° F. is first mixed with 30 mL of the 1% Carezyme® solution (1% volume/wt addition of Carezyme® 5.0 L on bone dry pulp) for approximately 15 seconds via a Lightnin® lab mixer (Lightnin', Rochester, N.Y.) in a 120° F. water bath. The unmodified pulp cake is preheated to approximately 120° F. via a microwave oven and is then added to the enzyme/water mixture. The mixing rate of the pulp/enzyme slurry is increased to achieve continuous turn over and agitation and allowed to react for approximately 1 hour. At the end of the enzyme reaction period, 30 mL of a 1% (wt/vol) solution of lauryl trimethyl ammonium chloride (Sherex Chemical Co, Witco Corp., Greenwich, Conn.) in distilled water is added to the enzyme/pulp slurry to achieve a 1% add-on level (wt active chemical/wt dry fiber basis) and allowed to continue mixing for 55 minutes at 120° F. After mixing of the lauryl trimethyl ammonium chloride and the modified pulp slurry, 15 mL of a 2% solution of carboxymethyl cellulose (Aqualon Company, Wilmington, Del.) (1% wt active chemical/wt dry fiber basis) is added and allowed to continue mixing for 5 minutes. The slurry of modified fibers is then made directly into low density handsheets without filtering, quenching or disintegration.

Sample 1N is Made from NSK Pulp that is Modified by the Following Process:

Three unmodified pulp cakes prepared from section B above are treated at approximately a 5% consistency in a Quantum Mark III high intensity lab mixer. Distilled water preheated to 120° F. is first mixed with 45 mL of a 2% Carezyme® solution (1% volume/wt addition of Carezyme® 5.0 L on bone dry pulp) for approximately 10 seconds and transferred to the mixing vessel which has been programmed to maintain 120° F. temperature. The unmodified pulp cakes are preheated to approximately 120° F. via a microwave oven and are then added to the enzyme/water mixture. After the lid is secured to the top of the vessel, the mixer shaft is then engaged to mix at a rate of approximately 1,200 RPM (high intensity mixing) for 10 seconds and then stopped. For the remainder of the hour, mixing at 1,200 RPM for 10 seconds occurs every 10 minutes. At the end of the enzyme reaction period, the pulp slurry is quantitatively transferred and dewatered in a Buchner funnel with cheesecloth to retain as much material as possible. The resulting pulp cake is peeled from the cheesecloth and is then added to approximately 3,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the pulp slurry is quantitatively transferred and dewatered in a Buchner funnel with cheesecloth to retain as much material as possible. The cake is then rinsed with approximately 1,500 mL of distilled water and dewatered. The resulting pulp cake is peeled from the cheesecloth and a sample corresponding to 30 bone dry grams is then diluted to 2,000 mL with tap water and disintegrated for 3,000 revolutions in a TAPPI Standard Desintigrator before handsheet making.

Sample 1O is Made from NSK Pulp that is Modified by the Following Process:

Six unmodified pulp cakes prepared from section B above are treated at approximately a 10% consistency in a Quantum Mark III high intensity lab mixer. Distilled water preheated to 120° F. is first mixed with 90 mL of a 2% Carezyme® solution (1% volume/wt addition of Carezyme® 5.0 L on bone dry pulp) for approximately 10 seconds and transferred to the mixing vessel which has been programmed to maintain 120° F. temperature. The unmodified pulp cakes are preheated to approximately 120° F. via a microwave oven and are then added to the enzyme/water mixture. After the lid is secured to the top of the vessel, the mixer shaft is then engaged to mix at a rate of approximately 1,200 RPM (high intensity mixing) for 10 seconds and then stopped. For the remainder of the hour, mixing at 1,200 RPM for 10 seconds occurs every 10 minutes for a total of 70 seconds. At the end of the enzyme reaction period, the pulp slurry is quantitatively transferred and dewatered in a Buchner funnel with cheesecloth to retain as much material as possible. The resulting pulp cake is peeled from the cheesecloth and is then added to approximately 6,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the pulp slurry is quantitatively transferred and dewatered in a Buchner funnel with cheesecloth to retain as much material as possible. The cake is then rinsed with approximately 3,000 mL of distilled water and dewatered. The resulting pulp cake is peeled from the cheesecloth and a sample corresponding to 30 bone dry grams is then diluted to 2,000 mL with tap water and disintegrated for 3,000 revolutions in a TAPPI Standard Desintigrator before handsheet making.

Sample 1P is Made from NSK Pulp that is Modified by the Following Process:

Eight unmodified pulp cakes prepared from section B above are treated at approximately a 13.3% consistency in a Quantum Mark III high intensity lab mixer. Distilled water preheated to 120° F. is first mixed with 135 mL of a 2% Carezyme® solution (1.12% volume/wt addition of Carezyme® 5.0 L on bone dry pulp) for approximately 10 seconds and transferred to the mixing vessel which has been programmed to maintain 120° F. temperature. The unmodified pulp cakes are preheated to approximately 120° F. via a microwave oven and are then added to the enzyme/water mixture. After the lid is secured to the top of the vessel, the mixer shaft is then engaged to mix at a rate of approximately 1,200 RPM (high intensity mixing) for 10 seconds and then stopped. For the remainder of the hour, mixing at 1,200 RPM for 10 seconds occurs every 10 minutes. At the end of the enzyme reaction period, the pulp slurry is quantitatively transferred and dewatered in a Buchner funnel with cheesecloth to retain as much material as possible. The resulting pulp cake is peeled from the cheesecloth and is then added to approximately 6,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the pulp slurry is quantitatively transferred and dewatered in a Buchner funnel with cheesecloth to retain as much material as possible. The cake is then rinsed with approximately 5,000 mL of distilled water and dewatered. The resulting pulp cake is peeled from the cheesecloth and a sample corresponding to 30 bone dry grams is then diluted to 2,000 mL with tap water and disintegrated for 3,000 revolutions in a TAPPI Standard Desintigrator before handsheet making.

Sample 1Q is Made from NSK Pulp that is Modified by the Following Process:

Six unmodified pulp cakes prepared from section B above are treated at approximately a 10% consistency in a Quantum Mark III high intensity lab mixer. Distilled water preheated to 120° F. is first mixed with 90 mL of a 2% Carezymee solution (1% volume/wt addition of Carezyme® 5.0 L on bone dry pulp) for approximately 10 seconds and transferred to the mixing vessel which has been programmed to maintain 120° F. temperature. The unmodified pulp cakes are preheated to approximately 120° F. via a microwave oven and are then added to the enzyme/water mixture. After the lid is secured to the top of the vessel, the mixer shaft is then engaged to mix at a rate of approximately 1,200 RPM (high intensity mixing) for 10 seconds. After the initial high intensity mixing step, low intensity mixing at 120 RPM for 10 seconds duration is accomplished every 2 minutes for the remainder of the hour except at times of 25, 40, and 50 minutes where high intensity mixing at 1,200 RPM is done at 20 second durations. At the end of the enzyme reaction period, a combination of 40 mL of a 4% (wt/vol) emulsion (0.9% add-on to dry fibers) of dihdrogenated tallow dimethyl ammonium methyl sulfate (Sherex Chemical Co, Witco Corp., Greenwich, Conn.) in distilled water and 50 mL of a 4% (wt/vol) solution (1.1% add-on to dry fibers) of lauryl trimethyl ammonium chloride (Sherex Chemical Co, Witco Corp., Greenwich, Conn.) in distilled water and is added to the enzyme/pulp slurry to achieve a 2% total add-on level (wt active chemical/wt dry fiber basis). After the lid is again secured to the top of the vessel, the mixer shaft is then engaged to mix at a rate of approximately 1,200 RPM (high intensity mixing) for 10 seconds and then stopped. For the next 30 minutes, mixing at a rate of approximately 1,200 RPM for 10 seconds occurs every 3 minutes. At the end of the treatment period, the pulp slurry is quantitatively transferred and dewatered in a Buchner funnel with cheesecloth to retain as much material as possible. The cake is then rinsed with approximately 3,000 mL of distilled water and dewatered. The resulting pulp cake is peeled from the cheesecloth and a sample corresponding to 30 bone dry grams is then diluted to 2,000 mL with tap water and disintegrated for 3,000 revolutions in a TAPPI Standard Desintigrator before handsheet making.

Table 1 gives the results of the density, dry tensile index, dry and wet zero span tensiles indices, and DT/DZST ratios of the low density handsheet samples made. It can be seen from the Table that enzyme modification of the fibers with Carezyme® results in substantial reduction of the dry zero span tensile index (DZST) of the NSK fibers while maintaining or improving the overall dry tensile index (DT) of the sheet compared to the handsheet sample produced from unmodified control fibers. The addition of chemical debonders to the enzyme modified fibers further reduces the DZST. Furthermore, high intensity mixing combined with the enzyme treatment, as well as both enzyme and debonder treatment steps, results in even greater reductions in DZST without negatively impacting sheet tensile.

TABLE 1

| Sample (description*) | Density (g/cc) | DZST (N m/g) | % DZST reduction | DT (N m/g) | DZST/DT ratio | WZST (N m/g) |
|---|---|---|---|---|---|---|
| Control NSK** | 0.174 | 138.9 | — | 16.3 | 8.5 | 121.0 |
| 1A (1% HMB)** | 0.152 | 142.8 | −2.8 | 14.5 | 9.8 | 118.0 |
| 1B (3% TEAB)** | 0.195 | 137.9 | 0.7 | 15.2 | 9.1 | 120.2 |
| 1C (1% LTAC)** | 0.153 | 134.6 | 3.1 | 14.0 | 9.6 | 113.7 |
| 1D (1% B10S)** | 0.153 | 138.4 | 0.4 | 12.8 | 10.8 | 125.2 |
| 1E (1% Cz) | 0.145 | 97.1 | 30.1 | 19.4 | 5.0 | 45.3 |
| 1F (2% Cz) | 0.148 | 93.8 | 32.5 | 16.1 | 5.8 | 43.3 |
| 1G (1% Cz, 1% HMB) | 0.156 | 81.5 | 41.3 | 18.6 | 4.4 | 34.7 |
| 1H (2% Cz, 1% HMB) | 0.125 | 74.8 | 46.2 | 14.2 | 5.3 | 27.7 |
| 1I (1% Cz, 1% TEAB) | 0.154 | 80.6 | 42.0 | 16.5 | 4.9 | 36.0 |
| 1J (1% Cz, 1% LTAC) | 0.153 | 89.3 | 35.7 | 17.3 | 5.2 | 38.9 |
| 1K (1% Cz, 1% TEA) | 0.155 | 93.5 | 32.7 | 19.6 | 4.8 | 45.2 |
| 1L(1% Cz, 1% B10S) | 0.155 | 91.2 | 34.3 | 17.6 | 5.2 | 45.3 |
| 1M (1% Cz, 1% LTAC/ 1% CMC) | 0.147 | 79.6 | 42.7 | 18.4 | 4.3 | 29.1 |
| 1N (1% Cz, HIM 5% k) | 0.136 | 99.8 | 28.2 | 17.6 | 5.7 | 46.0 |
| 1O (1% Cz, HIM 10% k) | 0.134 | 90.7 | 34.7 | 19.1 | 4.7 | 33.5 |
| 1P (1.1% Cz, HIM 13.3% k) | 0.122 | 81.3 | 41.5 | 19.8 | 4.1 | 22.5 |
| 1Q (1% Cz, 0.9% DTDMAMS + 1.1% LTAC, HIM 10% k throughout) | 0.156 | 73.7 | 46.9 | 22.9 | 3.2 | 21.0 |

*Cz = Carezyme ® 5.0 L
HMB = hexamethonium bromide
TEAB = tetraethylammonium bromide
LTAC = lauryl trimethylammonium chloride
TEA = triethanolamine
B10S = Barlox ® 10S
CMC = carboxymethyl cellulose
HIM = high intensity mixing
k = consistency
DTDMAMS = dihydrogenated tallow dimethyl ammonium methyl sulfate
**Not an example of the present invention.

Example 2

Treatment of NSK Fibers with Celluclast®

Northern Softwood Kraft (NSK) pulp cakes from section B above are treated and made into 4 low density handsheet samples (6 sheets per sample) using the procedure outlined above. The control NSK pulp is the same as in Table 1.

Sample 2A is Made from NSK Pulp that is Modified by the Following Process:

The fibers are treated at approximately 3% starting consistency in a 50 millimolar buffer solution of sodium acetate and acetic acid of pH 4.7. The buffer solution, preheated to 120° F., is first mixed with 30 mL of a 1% Celluclast® solution (1% volume/wt addition of Celluclast® 1.5 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/buffer mixture. The mixing rate of the Lightnin'® mixer is increased to achieve continuous turn over and agitation of the pulp slurry and allowed to react for approximately 1 hour. At the end of the hour, the pulp slurry is quantitatively transferred and dewatered in a Buchner funnel with filter paper. The modified pulp cake is then added to approximately 1,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 2B is Made from NSK Pulp that is Modified by the Following Process:

The fibers are treated at approximately 3% consistency in a 50 millimolar buffer solution of sodium acetate and acetic acid of pH 4.7. The buffer solution, preheated to 120° F., is first mixed with 60 mL of a 1% Celluclast® solution (2% volume/wt addition of Celluclast® 1.5 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/buffer mixture. The mixing rate of the Lightnin'® mixer is increased to achieve continuous turn over and agitation of the pulp slurry and allowed to react for approximately 1 hour. At the end of the hour, the pulp slurry is quantitatively transferred and dewatered in a Buchner funnel with filter paper. The modified pulp cake is then added to approximately 1,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 2C is Made from NSK Pulp that is Modified by the Following Process:

The fibers are treated at approximately 3% consistency in a 50 millimolar buffer solution of sodium acetate and acetic acid of pH 4.7. The buffer solution, preheated to 120° F., is first mixed with 30 mL of a 1% Celluclast® solution (1% volume/wt addition of Celluclast® 1.5 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/buffer mixture. The mixing rate of the Lightnin'® mixer is increased to achieve continuous turn over and agitation of the pulp slurry and allowed to react for approximately 1 hour. At the end of the enzyme reaction period, 30 mL of a 1% (wt/vol) solution of hexamethonium bromide (Aldrich Chemical Company Milwaukee, Wis. catalogue No. 21,967-3) in distilled water is added to the enzyme/pulp slurry to achieve a 1% add-on level (wt active chemical/wt dry fiber basis) and allowed to continue mixing for a second hour at 120° F. At the end of the second hour, the slurry of modified fibers is made directly into low density handsheets without filtering, quenching or disintegration.

Sample 2D is Made from NSK Pulp that is Modified by the Following Process:

The fibers are treated at approximately 3% consistency in a 50 millimolar buffer solution of sodium acetate and acetic acid of pH 4.7. The buffer solution, preheated to 120° F., is first mixed with 60 mL of a 1% Celluclast® solution (2% volume/wt addition of Celluclast® 1.5 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/buffer mixture. The mixing rate of the Lightnin'® mixer is increased to achieve continuous turn over and agitation of the pulp slurry and allowed to react for approximately 1 hour. At the end of the enzyme reaction period, 30 mL of a 1% (wt/vol) solution of hexamethonium bromide (Aldrich Chemical Company Milwaukee, Wis. catalogue No. 21,967-3) in distilled water is added to the enzyme/pulp slurry to achieve a 1% add-on level (wt active chemical/wt dry fiber basis) and allowed to continue mixing for a second hour at 120° F. At the end of the second hour, the slurry of modified fibers is made directly into low density handsheets without filtering, quenching or disintegration.

Table 2 gives the results of the density, dry tensile index, dry and wet zero span tensiles indices, and DT/DZST ratios of the low density handsheet samples made. It can be seen from the Table that enzyme modification of the fibers with Celluclast® results in substantial reduction of the dry zero span tensile index (DZST) of the NSK fibers while maintaining or improving the overall dry tensile index (DT) of the sheet compared to the handsheet sample produced from unmodified control fibers. The addition of chemical debonders to the enzyme modified fibers further reduces the DZST.

TABLE 2

| Sample (description*) | Density (g/cc) | DZST (N m/g) | % DZST reduction | DT (N m/g) | DZST/DT ratio | WZST (N m/g) |
|---|---|---|---|---|---|---|
| Control NSK** | 0.174 | 138.9 | — | 16.3 | 8.5 | 121.0 |
| 2A (1% CC) | 0.148 | 109.8 | 21.0 | 20.1 | 5.5 | 61.1 |
| 2B (2% CC) | 0.153 | 96.7 | 30.4 | 16.7 | 5.8 | 42.1 |
| 2C (1% CC, 1% HMB) | 0.140 | 101.8 | 26.8 | 16.1 | 6.3 | 47.9 |
| 2D (2% CC, 1% HMB) | 0.151 | 79.1 | 43.1 | 15.9 | 5.0 | 31.3 |

*CC = Celluclast ® 1.5 L
HMB = hexamethonium bromide
**Not an example of the present invention

Example 3

Treatment of NSK Fibers with Celluzyme® or Pergolase®

Northern Softwood Kraft (NSK) pulp cakes from section B above are treated and made into 2 low density handsheet samples (6 sheets per sample) using the procedure outlined above. The control NSK pulp is the same as in Table 1.

Sample 3A is Made from NSK Pulp that is Modified by the Following Process:

The fibers are treated at approximately 3% consistency. Distilled water preheated to 120° F. is first mixed with 1.89 g of Celluzyme® 0.7 T (6.3% wt/wt addition of Celluzyme® 0.7 T on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the hour, the pulp slurry is quantitatively transferred and dewatered in a Buchner funnel with filter paper. The modified pulp cake is then added to approximately 1,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 3B is Made from NSK Pulp that is Modified by the Following Process:

The fibers are treated at approximately 3% consistency in a 50 millimolar buffer solution of sodium acetate and acetic acid of pH 4.7. The buffer solution, preheated to 120° F., is first mixed with 30 mL of a 1% Pergolase® solution (1% volume/wt addition of Pergolase® A40 on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/buffer mixture. The mixing rate of the Lightnin'® mixer is increased to achieve continuous turn over and agitation of the pulp slurry and allowed to react for approximately 1 hour. At the end of the hour, the pulp slurry is quantitatively transferred and dewatered in a Buchner funnel with filter paper. The modified pulp cake is then added to approximately 1,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Table 3 gives the results of the density, dry tensile index, dry and wet zero span tensiles indices, and DT/DZST ratios of the low density handsheet samples made. It can be seen from the Table that enzyme modification of the fibers with Celluzyme® and Pergolase® results in substantially reducing the dry zero span tensile index (DZST) of the NSK fibers while maintaining or improving the overall dry tensile index (DT) of the sheet compared to the handsheet sample produced from unmodified control fibers.

TABLE 3

| Sample (description*) | Density (g/cc) | DZST (N m/g) | % DZST reduction | DT (N m/g) | DZST/DT ratio | WZST (N m/g) |
|---|---|---|---|---|---|---|
| Control NSK* | 0.174 | 138.9 | — | 16.3 | 8.5 | 121.0 |
| 3A (6.3% Celluzyme ®) | 0.155 | 77.6 | 44.1 | 19.0 | 4.1 | 33.9 |
| 3B (1% Pergolase ®) | 0.135 | 104.1 | 25.1 | 16.6 | 6.3 | 53.8 |

*Not an example of the present invention

Example 4

Treatment of Eucalyptus Fibers with Carezyme®

Eucalyptus (Euc) pulp cakes from section B above are treated and made into 5 low density handsheet samples (6 sheets per sample) using the procedure outlined above. The control eucalyptus pulp is left unmodified and is diluted to 2,000 mL with tap water and disintegrated for 3,000 revolutions in a TAPPI Standard Desintigrator before handsheet making.

Sample 4A is Made from Eucalyptus Pulp that is Modified by the Following Process:

The fibers are treated at approximately 3% consistency. Distilled water preheated to 120° F. is first mixed with 30 mL of a 1% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the hour, the pulp slurry is quantitatively transferred and dewatered in a Buchner funnel with filter paper. The modified pulp cake is then added to approximately 1,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 4B is Made from Eucalyptus Pulp that is Modified by the Following Process:

The fibers are treated at approximately 3% consistency. Distilled water preheated to 120° F. is first mixed with 60 mL of a 1% Carezyme® solution (2% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the hour, the pulp slurry is quantitatively transferred and dewatered in a Buchner funnel with filter paper. The modified pulp cake is then added to approximately 1,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 4C is Made from NSK Pulp that is Modified by the Following Process:

The fibers are treated at approximately 3% starting consistency. Distilled water preheated to 120° F. is first mixed with 30 mL of a 1% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the enzyme reaction period, 30 mL of a 1% (wt/vol) solution of hexamethonium bromide (Aldrich Chemical Company Milwaukee, Wis. catalogue No. 21,967-3) in distilled water is added to the enzyme/pulp slurry to achieve a 1% add-on level (wt active chemical/wt dry fiber basis) and allowed to continue mixing for a second hour at 120° F. At the end of the second hour, the slurry of modified fibers is made directly into low density handsheets without filtering, quenching or disintegration.

Sample 4D is Made from Eucalyptus Pulp that is Modified by the Following Process:

The fibers are treated at approximately 3% starting consistency. Distilled water preheated to 120° F. is first mixed with 60 mL of a 1% Carezyme® solution (2% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the enzyme reaction period, 30 mL of a 1% (wt/vol) solution of hexamethonium bromide (Aldrich Chemical Company Milwaukee, Wis. catalogue No. 21,967-3) in distilled water is added to the enzyme/pulp slurry to achieve a 1% add-on level (wt active chemical/wt dry fiber basis) and allowed to continue mixing for a second hour at 120° F. At the end of the second hour, the slurry of modified fibers is made directly into low density handsheets without filtering, quenching or disintegration.

Sample 4E is Made from Eucalyptus Pulp that is Modified by the Following Process:

The fibers are treated at approximately 3% starting consistency. Distilled water preheated to 120° F. is first mixed with 30 mL of a 1% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the enzyme reaction period, 30 mL of a 1% (wt/vol) solution of tetraethylammonium bromide (Aldrich Chemical Company Milwaukee, Wis. catalogue No. 14,002-3) in distilled water is added to the enzyme/pulp slurry to achieve a 1% add-on level (wt active chemical/wt dry fiber basis) and allowed to continue mixing for a second hour at 120° F. At the end of the second hour, the slurry of modified fibers is made directly into low density handsheets without filtering, quenching, or disintegration.

Table 4 gives the results of the density, dry tensile index, dry and wet zero span tensiles indices, and DT/DZST ratios of the low density handsheet samples made. It can be seen from the table that enzyme modification of the fibers with Carezyme® results in substantial reduction of the dry zero span tensile index (DZST) of the hardwood eucalyptus fibers while maintaining or improving the overall dry tensile index (DT) of the sheet compared to the handsheet sample produced from unmodified control fibers. The addition of chemical debonders to the enzyme modified fibers further reduces the DZST.

TABLE 4

| Sample (description*) | Density (g/cc) | DZST (N m/g) | % DZST reduction | DT (N m/g) | DZST/DT ratio | WZST (N m/g) |
|---|---|---|---|---|---|---|
| Control Euc** | 0.168 | 127.7 | — | 8.6 | 14.8 | 96.2 |
| 4A (1% Cz) | 0.144 | 103.7 | 18.8 | 9.5 | 10.9 | 67.0 |
| 4B (2% Cz) | 0.123 | 102.4 | 19.8 | 9.3 | 11.0 | 72.2 |
| 4C (1% Cz, 1% HMB) | 0.134 | 82.5 | 35.4 | 10.4 | 8 | 37.7 |
| 4D (2% Cz, 1% HMB) | 0.119 | 85.5 | 33.1 | 8.3 | 10.3 | 44.1 |
| 4E (1% Cz, 1% TEAB) | 0.135 | 93.7 | 26.6 | 10.4 | 9.0 | 47.4 |

*Cz = Carezyme ® 5.0 L
HMB = hexamethonium bromide
TEAB = tetraethylammonium bromide
**Not an example of the present invention.

Example 5

Treatment of Eucalyptus Fibers with Celluclast®

Eucalyptus (Euc) pulp cakes from section B above are treated and made into 4 low density handsheet samples (6 sheets per sample) using the procedure outlined above. The control eucalyptus pulp is the same as in Table 4.

Sample 5A is Made from NSK Pulp that is Modified by the Following Process:

The fibers are treated at approximately 3% starting consistency in a 50 millimolar buffer solution of sodium acetate and acetic acid of pH 4.7. The buffer solution, preheated to 120° F., is first mixed with 30 mL of a 1% Celluclast® solution (1% volume/wt addition of Celluclast® 1.5 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/buffer mixture. The mixing rate of the Lightnin'® mixer is increased to achieve continuous turn over and agitation of the pulp slurry and allowed to react for approximately 1 hour. At the end of the hour, the pulp slurry is quantitatively transferred and dewatered in a Buchner funnel with filter paper. The modified pulp cake is then added to approximately 1,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 5B is Made from NSK Pulp that is Modified by the Following Process:

The fibers are treated at approximately 3% consistency in a 50 millimolar buffer solution of sodium acetate and acetic acid of pH 4.7. The buffer solution, preheated to 120° F., is first mixed with 60 mL of a 1% Celluclast® solution (2% volume/wt addition of Celluclast® 1.5 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/buffer mixture. The mixing rate of the Lightnin'® mixer is increased to achieve continuous turn over and agitation of the pulp slurry and allowed to react for approximately 1 hour. At the end of the hour, the pulp slurry is quantitatively transferred and dewatered in a Buchner funnel with filter paper. The modified pulp cake is then added to approximately 1,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 5C is Made from NSK Pulp that is Modified by the Following Process:

The fibers are treated at approximately 3% consistency in a 50 millimolar buffer solution of sodium acetate and acetic acid of pH 4.7. The buffer solution, preheated to 120° F., is first mixed with 30 mL of a 1% Celluclast® solution (1% volume/wt addition of Celluclast® 1.5 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/buffer mixture. The mixing rate of the Lightnin'® mixer is increased to achieve continuous turn over and agitation of the pulp slurry and allowed to react for approximately 1 hour. At the end of the enzyme reaction period, 30 mL of a 1% (wt/vol) solution of hexamethonium bromide (Aldrich Chemical Company Milwaukee, Wis. catalogue No. 21,967-3) in distilled water is added to the enzyme/pulp slurry to achieve a 1% add-on level (wt active chemical/wt dry fiber basis) and allowed to continue mixing for a second hour at 120° F. At the end of the second hour, the slurry of modified fibers is made directly into low density handsheets without filtering, quenching or disintegration.

Sample 5D is Made from NSK Pulp that is Modified by the Following Process:

The fibers are treated at approximately 3% consistency in a 50 millimolar buffer solution of sodium acetate and acetic acid of pH 4.7. The buffer solution, preheated to 120° F., is first mixed with 60 mL of a 1% Celluclast® solution (2% volume/wt addition of Celluclast® 1.5 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/ buffer mixture. The mixing rate of the Lightnin'® mixer is increased to achieve continuous turn over and agitation of the pulp slurry and allowed to react for approximately 1 hour. At the end of the enzyme reaction period, 30 mL of a 1% (wt/vol) solution of hexamethonium bromide (Aldrich Chemical Company Milwaukee, Wis. catalogue No. 21,967-3) in distilled water is added to the enzyme/pulp slurry to achieve a 1% add-on level (wt active chemical/wt dry fiber basis) and allowed to continue mixing for a second hour at 120° F. At the end of the second hour, the slurry of modified fibers is made directly into low density handsheets without filtering, quenching or disintegration.

Table 5 gives the results of the density, dry tensile index, dry and wet zero span tensiles indices, and DT/DZST ratios of the low density handsheet samples made. It can be seen from the table that enzyme modification of the hardwood eucalyptus fibers with Celluclast® results in substantially reducing the dry zero span tensile index (DZST) of the NSK fibers while maintaining or improving the overall dry tensile index (DT) of the sheet compared to the handsheet sample produced from unmodified control fibers. The addition of chemical debonders to the enzyme modified fibers further reduces the DZST.

TABLE 5

| Sample (description*) | Density (g/cc) | DZST (N m/g) | % DZST reduction | DT (N m/g) | DZST/DT ratio | WZST (N m/g) |
|---|---|---|---|---|---|---|
| Control EUC** | 0.168 | 127.7 | — | 8.6 | 14.8 | 96.2 |
| 5A (1% CC) | 0.132 | 99.9 | 21.8 | 9.9 | 10.1 | 55.8 |
| 5B (2% CC) | 0.128 | 79.1 | 38.1 | 8.2 | 9.6 | 39.3 |
| 5C (1% CC, 1% HMB) | 0.117 | 89.9 | 29.6 | 8.0 | 11.2 | 49.5 |
| 5D (2% CC, 1% HMB) | 0.108 | 62.8 | 50.8 | 4.4 | 14.3 | 30.3 |

*CC = Celluclast ® 1.5 L
HMB = hexamethonium bromide
**Not an example of the present invention.

Example 6

Treatment of Eucalyptus Fibers with Celluzyme®

Eucalyptus (Euc) pulp cakes from section B above are treated and made into one low density handsheet samples (6 sheets per sample) using the procedure outlined above. The control eucalyptus pulp is the same as in Table 4.

Sample 6A is Made from Eucalyptus Pulp that is Modified by the Following Process:

The fibers are treated at approximately 3% consistency. Distilled water preheated to 120° F. is first mixed with 1.89 g of Celluzyme® 0.7 T (6.3% wt/wt addition of Celluzyme® 0.7 T on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the hour, the pulp slurry is quantitatively transferred and dewatered in a Buchner funnel with filter paper. The modified pulp cake is then added to approximately 1,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

TABLE 6

| Sample (description*) | Density (g/cc) | DZST (N m/g) | % DZST reduction | DT (N m/g) | DZST/DT ratio | WZST (N m/g) |
|---|---|---|---|---|---|---|
| Control Euc* | 0.168 | 127.7 | — | 8.6 | 14.8 | 96.2 |
| 6A (6.3% Celluzyme ®) | 0.115 | 74.7 | 41.5 | 8.5 | 8.8 | 34.5 |

*Not an example of the present invention

Example 7

Treatment of Northern Hardwood Sulfite (NHS) with Carezyme®

Northern Hardwood Sulfite (NHS) pulp cakes from section B above are treated and made into 3 low density handsheet samples (6 sheets per sample) using the procedure outlined above. The control NHS pulp is left unmodified and is diluted to 2,000 mL with tap water and disintegrated for 3,000 revolutions in a TAPPI Standard Desintigrator before handsheet making.

Sample 7A is Made from NHS Pulp that is Modified by the Following Process:

The fibers are treated at approximately 3% consistency. Distilled water preheated to 120° F. is first mixed with 30 mL of a 1% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the hour, the pulp slurry is quantitatively transferred and dewatered in a Buchner funnel with filter paper. The modified pulp cake is then added to approximately 1,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 7B is Made from NSK Pulp that is Modified by the Following Process:

The fibers are treated at approximately 3% starting consistency. Distilled water preheated to 120° F. is first mixed with 30 mL of a 1% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the enzyme reaction period, 30 mL of a 1% (wt/vol) solution of hexamethonium bromide (Aldrich Chemical Company Milwaukee, Wis. catalogue No. 21,967-3) in distilled water is added to the enzyme/pulp slurry to achieve a 1% add-on level (wt active chemical/wt dry fiber basis) and allowed to continue mixing for a second hour at 120° F. At the end of the second hour, the slurry of modified fibers is made directly into low density handsheets without filtering, quenching or disintegration.

Table 7 gives the results of the density, dry tensile index, dry and wet zero span tensiles indices, and DT/DZST ratios of the low density handsheet samples made. It can be seen from the table that enzyme modification of the fibers with Carezyme® results in substantially reducing the dry zero span tensile index (DZST) of the NHS fibers while maintaining or improving the overall dry tensile index (DT) of the sheet compared to the handsheet sample produced from unmodified control fibers. The addition of chemical debonders to the enzyme modified fibers further reduces the DZST.

TABLE 7

| Sample (description*) | Density (g/cc) | DZST (N m/g) | % DZST reduction | DT (N m/g) | DZST/DT ratio | WZST (N m/g) |
|---|---|---|---|---|---|---|
| Control NHS** | 0.095 | 95.3 | — | 3.1 | 30.7 | 85.1 |
| 7A (1% Cz) | 0.097 | 71.0 | 25.5 | 6.3 | 11.3 | 35.4 |
| 7B (1% Cz, 1% HMB) | 0.094 | 60.2 | 36.2 | 5.3 | 11.4 | 28.7 |

*Cz = Carezyme ® 5.0 L
HMB = hexamethonium bromide
**Not an example of the present invention.

Example 8

Treatment of Northern Hardwood Sulfite with Celluclast®

Northern Hardwood Sulfite (NHS) pulp cakes from section B above are treated and made into 4 low density handsheet samples (6 sheets per sample) using the procedure outlined above. The control NHS pulp is the same as in Table 7.

Sample 8A is Made from NHS Pulp that is Modified by the Following Process:

The fibers are treated at approximately 3% starting consistency in a 50 millimolar buffer solution of sodium acetate and acetic acid of pH 4.7. The buffer solution, preheated to 120° F., is first mixed with 30 mL of a 1% Celluclast® solution (1% volume/wt addition of Celluclast® 1.5 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/buffer mixture. The mixing rate of the Lightnin'® mixer is increased to achieve continuous turn over and agitation of the pulp slurry and allowed to react for approximately 1 hour. At the end of the hour, the pulp slurry is quantitatively transferred and dewatered in a Buchner funnel with filter paper. The modified pulp cake is then added to approximately 1,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 8B is Made from NHS Pulp that is Modified by the Following Process:

The fibers are treated at approximately 3% consistency in a 50 millimolar buffer solution of sodium acetate and acetic acid of pH 4.7. The buffer solution, preheated to 120° F., is first mixed with 60 mL of a 1% Celluclast'® solution (2% volume/wt addition of Celluclast® 1.5 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/buffer mixture. The mixing rate of the Lightnin'® mixer is increased to achieve continuous turn over and agitation of the pulp slurry and allowed to react for approximately 1 hour. At the end of the hour, the pulp slurry is quantitatively transferred and dewatered in a Buchner funnel with filter paper. The modified pulp cake is then added to approximately 1,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 8C is Made from NHS Pulp that is Modified by the Following Process:

The fibers are treated at approximately 3% consistency in a 50 millimolar buffer solution of sodium acetate and acetic acid of pH 4.7. The buffer solution, preheated to 120° F., is first mixed with 30 mL of a 1% Celluclast® solution (1% volume/wt addition of Celluclast® 1.5 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/buffer mixture. The mixing rate of the Lightnin'® mixer is increased to achieve continuous turn over and agitation of the pulp slurry and allowed to react for approximately 1 hour. At the end of the enzyme reaction period, 30 mL of a 1% (wt/vol) solution of hexamethonium bromide (Aldrich Chemical Company Milwaukee, Wis. catalogue No. 21,967-3) in distilled water is added to the enzyme/pulp slurry to achieve a 1% add-on level (wt active chemical/wt dry fiber basis) and allowed to continue mixing for a second hour at 120° F. At the end of the second hour, the slurry of modified fibers is made directly into low density handsheets without filtering, quenching or disintegration.

Sample 8D is Made from NSK Pulp that is Modified by the Following Process:

The fibers are treated at approximately 3% consistency in a 50 millimolar buffer solution of sodium acetate and acetic acid of pH 4.7. The buffer solution, preheated to 120° F., is first mixed with 60 mL of a 1% Celluclast® solution (2% volume/wt addition of Celluclast® 1.5 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/buffer mixture. The mixing rate of the Lightnin'® mixer is increased to achieve continuous turn over and agitation of the pulp slurry and allowed to react for approximately 1 hour. At the end of the enzyme reaction period, 30 mL of a 1% (wt/vol) solution of hexamethonium bromide (Aldrich Chemical Company Milwaukee, Wis. catalogue No. 21,967-3) in distilled water is added to the enzyme/pulp slurry to achieve a 1% add-on level (wt active chemical/wt dry fiber basis) and allowed to continue mixing for a second hour at 120° F. At the end of the second hour, the slurry of modified fibers is made directly into low density handsheets without filtering, quenching or disintegration.

Table 8 gives the results of the density, dry tensile index, dry and wet zero span tensiles indices, and DT/DZST ratios of the low density handsheet samples made. It can be seen from the table that enzyme modification of the fibers with Celluclast® results in substantially reducing the dry zero span tensile index (DZST) of the NHS fibers while maintaining or improving the overall dry tensile index (DT) of the sheet compared to the handsheet sample produced from unmodified control fibers. The addition of chemical debonders to the enzyme modified fibers further reduces the DZST.

TABLE 8

| Sample (description*) | Density (g/cc) | DZST (N m/g) | % DZST reduction | DT (N m/g) | DZST/DT ratio | WZST (N m/g) |
|---|---|---|---|---|---|---|
| Control NHS** | 0.095 | 95.3 | — | 3.1 | 30.7 | 85.1 |
| 8A (1% CC) | 0.094 | 64.3 | 32.5 | 7.5 | 8.6 | 46.3 |
| 8B (2% CC) | 0.099 | 55.7 | 41.6 | 6.4 | 8.7 | 37.3 |
| 8C (1% CC, 1% HMB) | 0.094 | 60.4 | 36.6 | 6.3 | 9.6 | 38 |
| 8D (2% CC, 1% HMB) | 0.091 | 47.6 | 50.1 | 3.4 | 14.0 | 26.9 |

*CC = Celluclast ® 1.5 L
HMB = hexamethonium bromide
**Not an example of the present invention

Example 9

Treatment of Southern Softwood Kraft Fibers with Carezyme®

Southern Softwood Kraft (SSK) pulp cakes from section B above are treated and made into 3 low density handsheet samples (6 sheets per sample) using the procedure outlined above. The control SSK pulp is left unmodified and is diluted to 2,000 mL with tap water and disintegrated for 3,000 revolutions in a TAPPI Standard Desintigrator before handsheet making.

Sample 9A is Made from SSK Pulp that is Modified by the Following Process:

The fibers are treated at approximately 3% starting consistency. Distilled water preheated to 120° F. is first mixed with 30 mL of a 1% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the enzyme reaction period, 30 mL of a 1% (wt/vol) solution of hexamethonium bromide (Aldrich Chemical Company Milwaukee, Wis. catalogue No. 21,967-3) in distilled water is added to the enzyme/pulp slurry to achieve a 1% add-on level (wt active chemical/wt dry fiber basis) and allowed to continue mixing for a second hour at 120° F. At the end of the second hour, the slurry of modified fibers is made directly into low density handsheets without filtering, quenching or disintegration.

Sample 9B is Made from NSK Pulp that is Modified by the Following Process:

The fibers are treated at approximately 3% starting consistency. Distilled water preheated to 120° F. is first mixed with 60 mL of a 1% Carezyme® solution (2% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the enzyme reaction period, 30 mL of a 1% (wt/vol) solution of hexamethonium bromide (Aldrich Chemical Company Milwaukee, Wis. catalogue No. 21,967-3) in distilled water is added to the enzyme/pulp slurry to achieve a 1% add-on level (wt active chemical/wt dry fiber basis) and allowed to continue mixing for a second hour at 120° F. At the end of the second hour, the slurry of modified fibers is made directly into low density handsheets without filtering, quenching or disintegration.

Table 9 gives the results of the density, dry tensile index, dry and wet zero span tensiles indices, and DT/DZST ratios of the low density handsheet samples made. It can be seen from the table that enzyme modification of the fibers with Carezyme® followed by debonder treatment results in substantially reducing the dry zero span tensile index (DZST) of the SSK fibers while maintaining or improving the overall dry tensile index (DT) of the sheet compared to the handsheet sample produced from unmodified fibers.

TABLE 9

| Sample (description*) | Density (g/cc) | DZST (N m/g) | % DZST reduction | DT (N m/g) | DZST/DT ratio | WZST (N m/g) |
|---|---|---|---|---|---|---|
| Control SSK** | 0.135 | 117.4 | — | 7.3 | 16.1 | 120.6 |
| 9A (1% CZ, 1% HMB) | 0.125 | 68 | 42.1 | 5.8 | 11.7 | 30.9 |
| 9B (2% CZ, 1% HMB) | 0.120 | 70.9 | 39.6 | 7.1 | 10.0 | 36.4 |

*Cz = Carezyme ® 5.0 L
HMB = hexamethonium bromide
**Not an example of the present invention

Example 10

Treatment of NSK Fibers and Fibrous Structures Having Improved Flexibility

Northern Softwood Kraft (NSK) pulp cakes from section B above are treated and made into 15 low density handsheet samples (6 sheets per sample) using the procedure outlined above. The control NSK pulp is left unmodified, diluted to 2,000 mL with tap water, and disintegrated for 3,000 revolutions in a TAPPI Standard Disintegrator before handsheet making.

Sample 10A is Made from NSK Pulp that is Modified by the Following Process:

The fibers are treated at approximately 3% consistency. Distilled water preheated to 120° F. is first mixed with 7.5 mL of a 2% Carezyme® solution (0.5% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the hour, the pulp slurry is quantitatively transferred and dewatered in a Buchner funnel with filter paper. The modified pulp cake is then added to approximately 1,000 mL of a 100 ppm NaOCl (4 mL of Clorox®, available from The Clorox Co., Oakland, Calif.) in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 10B is Made from NSK Pulp that is Modified by the Following Process:

The fibers are treated at approximately 3% consistency. Distilled water preheated to 120° F. is first mixed with 22.5 mL of a 2% Carezyme® solution (1.5% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the hour, the pulp slurry is quantitatively transferred and dewatered in a Buchner funnel with filter paper. The modified pulp cake is then added to approximately 1,000 mL of a 100 ppm NaOCl (4 mL of Clorox in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 10C is Made from NSK Pulp that is Modified by the Following Process:

The fibers are treated at approximately 3% starting consistency in a 50 millimolar buffer solution of sodium acetate and acetic acid of pH 4.7. The buffer solution, preheated to 120° F., is first mixed with 7.5 mL of a 2% Celluclast® solution (0.5% volume/wt addition of Celluclast® 1.5 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/buffer mixture. The mixing rate of the Lightnin'® mixer is increased to achieve continuous turn over and agitation of the pulp slurry and allowed to react for approximately 1 hour. At the end of the hour, the pulp slurry is quantitatively transferred and dewatered in a Buchner funnel with filter paper. The modified pulp cake is then added to approximately 1,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 10D is Made from NSK Pulp that is Modified by the Following Process:

The fibers are treated at approximately 3% consistency in a 50 millimolar buffer solution of sodium acetate and acetic acid of pH 4.7. The buffer solution, preheated to 120° F., is first mixed with 22.5 mL of a 2% Celluclast® solution (1.5% volume/wt addition of Celluclast® 1.5 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/buffer mixture. The mixing rate of the Lightnin'® mixer is increased to achieve continuous turn over and agitation of the pulp slurry and allowed to react for approximately 1 hour. At the end of the hour, the pulp slurry is quantitatively transferred and dewatered in a Buchner funnel with filter paper. The modified pulp cake is then added to approximately 1,000 mL of a 100 ppm NaOCl (4 mL of Clorox® in 2,000 mL of distilled water) solution, mixed, and allowed to react for a minimum of 5 minutes at room temperature to quench any further enzyme reactions with the cellulose. After quenching, the modified pulp slurry is quantitatively transferred and rinsed with approximately 1,500 mL of distilled water and dewatered in a Buchner funnel with filter paper. The resulting modified pulp cake is then diluted to 2,000 mL with tap water and disintegrated for 3,000 revolutions in a TAPPI Standard Desintigrator before handsheet making.

Preparation of n-Dodecenylsuccinate Disodium Salt:

500 g of distilled water were mixed with 3500 g of n-Dodecenylsuccinic Anhydride (98% concentration, Milliken Chemical Company, Inman, S.C.) at 70 degrees Centigrade for approximately 16 hours. Following the 16 hour reaction period, 3070 g of a 1% sodium sulfate solution was added and mixed for one more hour and removed from heat. 1000 g of a 50% sodium hydroxide solution was then slowly added to the emulsion with constant mixing to form a 49% concentration of the n-Dodecenylsuccinic acid monosodium salt. From this, a representative sample was obtained and diluted to 6% concentration with distilled water and the pH was adjusted to 9 with sodium hydroxide solution to form the n-Dodecenylsuccinate Disodium Salt.

Preparation of n-Octadecenylsuccinate Disodium Salt:

500 g of n-Octadecenylsuccinic Anhydride (100% concentration, Milliken Chemical Company, Inman, S.C.) was melted at 70 degrees Centigrade and then mixed with 50 g of distilled water for approximately 16 hours. Following the 16 hour reaction period, the emulsion was removed from heat and 218 g of a 50% sodium hydroxide solution was mixed in along with 2000 g of distilled water to form the n-Octadecenylsuccinate Disodium Salt. The emulsion was then mixed at room temperature for another 20 hours and then mixed with 100 g sodium sulfate crystals and 400 g distilled water. From this, a representative sample was obtained and diluted to 6% concentration with distilled water.

Sample 10E is Made from NSK Pulp that is Modified by the Following Process:

The fibers are treated at approximately 3% starting consistency. Distilled water preheated to 120° F. is first mixed with 15 mL of a 2% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the enzyme reaction period, the pH of the enzyme/pulp slurry is adjusted to approximately 10 with 0.1 normal sodium hydroxide. After pH adjustment, 25 mL of a 6% (wt/vol) solution of n-Dodecenylsuccinate Disodium Salt (preparation described above) is added to the enzyme/pulp slurry to achieve a 5% add-on level (wt active chemical/wt dry fiber basis) and allowed to continue mixing for 30 more minutes at 120° F. After 30 minutes mixing, the pH of the enzyme/pulp/n-Dodecenylsuccinate slurry is adjusted to pH 7 with 1 normal sulfuric acid. After pH adjustment, 1.75 g of calcium chloride (J. T. Baker, Phillipsburg, N.J.) dissolved in 20 mL distilled water is added to the enzyme/pulp/n-Dodecenylsuccinate slurry and mixed for another 5 minutes at 120° F. At the end of the treatment, the pulp slurry is quantitatively transferred and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 10F is Made from NSK Pulp that is Modified by the Following Process:

The fibers are treated at approximately 3% starting consistency. Distilled water preheated to 120° F. is first mixed with 15 mL of a 2% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the enzyme reaction period, the pH of the enzyme/pulp slurry is adjusted to approximately 10 with 0.1 normal sodium hydroxide. After pH adjustment, 5 mL of a 6% (wt/vol) solution of n-Dodecenylsuccinate Disodium Salt (preparation described above) is added to the enzyme/pulp slurry to achieve a 1% add-on level (wt active chemical/wt dry fiber basis) and allowed to continue mixing for 30 more minutes at 120° F. After 30 minutes mixing, the pH of the enzyme/pulp/n-Dodecenylsuccinate slurry is adjusted to pH 7 with 1 normal sulfuric acid. After pH adjustment, 0.43 g of zinc chloride (J. T. Baker, Phillipsburg, N.J.) dissolved in 20 mL distilled water is added to the enzyme/pulp/n-Dodecenylsuccinate slurry and mixed for another 5 minutes at 120° F. At the end of the treatment, the pulp slurry is quantitatively transferred and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 10G is Made from NSK Pulp that is Modified by the Following Process:

The fibers are treated at approximately 3% starting consistency. Distilled water preheated to 120° F. is first mixed with 15 mL of a 2% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the enzyme reaction period, the pH of the enzyme/pulp slurry is adjusted to approximately 10 with 0.1 normal sodium hydroxide. After pH adjustment, 25 mL of a 6% (wt/vol) solution of n-Dodecenylsuccinate Disodium Salt (preparation described above) is added to the enzyme/pulp slurry to achieve a 5% add-on level (wt active chemical/wt dry fiber basis) and allowed to continue mixing for 30 more minutes at 120° F. After 30 minutes mixing, the pH of the enzyme/pulp/n-Dodecenylsuccinate slurry is adjusted to pH 7 with 1 normal sulfuric acid. After pH adjustment, 2.15 g of zinc chloride (J. T. Baker, Phillipsburg, N.J.) dissolved in 20 mL distilled water is added to the enzyme/pulp/n-Dodecenylsuccinate slurry and mixed for another 5 minutes at 120° F. At the end of the treatment, the pulp slurry is quantitatively transferred and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 10H is Made from NSK Pulp that is Modified by the Following Process:

The fibers are treated at approximately 3% starting consistency. Distilled water preheated to 120° F. is first mixed with 15 mL of a 2% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the enzyme reaction period, the pH of the enzyme/pulp slurry is adjusted to approximately 10 with 0.1 normal sodium hydroxide. After pH adjustment, 5 mL of a 6% (wt/vol) solution of n-Octadecenylsuccinate Disodium Salt (preparation described above) is added to the enzyme/pulp slurry to achieve a 1% add-on level (wt active chemical/wt dry fiber basis) and allowed to continue mixing for 30 more minutes at 120° F. After 30 minutes mixing, the pH of the enzyme/pulp/n-Octadecenylsuccinate slurry is adjusted to pH 7 with 1 normal sulfuric acid. After pH adjustment, 0.27 g of calcium chloride (J. T. Baker, Phillipsburg, N.J.) dissolved in 20 mL distilled water is added to the enzyme/pulp/n-Octadecenylsuccinate slurry and mixed for another 5 minutes at 120° F. At the end of the treatment, the pulp slurry is quantitatively transferred and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 10I is Made from NSK Pulp that is Modified by the Following Process:

The fibers are treated at approximately 3% starting consistency. Distilled water preheated to 120° F. is first mixed with 15 mL of a 2% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the enzyme reaction period, the pH of the enzyme/pulp slurry is adjusted to approximately 10 with 0.1 normal sodium hydroxide. After pH adjustment, 25 mL of a 6% (wt/vol) solution of n-Octadecenylsuccinate Disodium Salt (preparation described above) is added to the enzyme/pulp slurry to achieve a 5% add-on level (wt active chemical/wt dry fiber basis) and allowed to continue mixing for 30 more minutes at 120° F. After 30 minutes mixing, the pH of the enzyme/pulp/n-Octadecenylsuccinate slurry is adjusted to pH 7 with 1 normal sulfuric acid. After pH adjustment, 1.36 g of calcium chloride (J. T. Baker, Phillipsburg, N.J.) dissolved in 20 mL distilled water is added to the enzyme/pulp/n-Octadecenylsuccinate slurry and mixed for another 5 minutes at 120° F. At the end of the treatment. the pulp slurry is quantitatively transferred and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 10J is Made from NSK Pulp that is Modified by the Following Process:

The fibers are treated at approximately 3% starting consistency. Distilled water preheated to 120° F. is first mixed with 15 mL of a 2% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the enzyme reaction period, the pH of the enzyme/pulp slurry is adjusted to approximately 10 with 0.1 normal sodium hydroxide. After pH adjustment, 5 mL of a 6% (wt/vol) solution of n-Dodecenylsuccinate Disodium Salt (preparation described above) is added to the enzyme/pulp slurry to achieve a 1% add-on level (wt active chemical/wt dry fiber basis) and allowed to continue mixing for 30 more minutes at 120° F. After 30 minutes mixing, the pH of the enzyme/pulp/n-Dodecenylsuccinate slurry is adjusted to pH 7 with 1 normal sulfuric acid. After pH adjustment, 0.35 g of calcium chloride (J. T. Baker, Phillipsburg, N.J.) dissolved in 20 mL distilled water is added to the enzyme/pulp/n-Dodecenylsuccinate slurry and mixed for another 5 minutes at 120° F. At the end of the treatment, the pulp slurry is quantitatively transferred and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 10K is Made from NSK Pulp that is Modified by the Following Process:

The fibers are treated at approximately 3% starting consistency. Distilled water preheated to 120° F. is first mixed with 15 mL of a 2% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'®) mixer is increased to achieve continuous turn over and agitation of the pulp slurry and allowed to react for approximately 1 hour. At the end of the enzyme reaction period, the pH of the enzyme/pulp slurry is adjusted to approximately 10 with 0.1 normal sodium hydroxide. After pH adjustment, 5 mL of a 6% (wt/vol) solution of n-Octadecenylsuccinate Disodium Salt (preparation described above) is added to the enzyme/pulp slurry to achieve a 1% add-on level (wt active chemical/wt dry fiber basis) and allowed to continue mixing for 30 more minutes at 120° F. After 30 minutes mixing, the pH of the enzyme/pulp/n-Octadecenylsuccinate slurry is adjusted to pH 7 with 1 normal sulfuric acid. After pH adjustment, 0.33 g of zinc chloride (J. T. Baker, Phillipsburg, N.J.) dissolved in 20 mL distilled water is added to the enzyme/pulp/n-Octadecenylsuccinate slurry and mixed for another 5 minutes at 120° F. At the end of the treatment, the pulp slurry is quantitatively transferred and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 10L is Made from NSK Pulp that is Modified by the Following Process:

The fibers are treated at approximately 3% starting consistency. Distilled water preheated to 120° F. is first mixed with 15 mL of a 2% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the enzyme reaction period, the pH of the enzyme/pulp slurry is adjusted to approximately 10 with 0.1 normal sodium hydroxide. After pH adjustment, 25 mL of a 6% (wt/vol) solution of n-Octadecenylsuccinate Disodium Salt (preparation described above) is added to the enzyme/pulp slurry to achieve a 5% add-on level (wt active chemical/wt dry fiber basis) and allowed to continue mixing for 30 more minutes at 120° F. After 30 minutes mixing, the pH of the enzyme/pulp/n-Octadecenylsuccinate slurry is adjusted to pH 7 with 1 normal sulfuric acid. After pH adjustment, 1.66 g of zinc chloride (J. T. Baker, Phillipsburg, N.J.) dissolved in 20 mL distilled water is added to the enzyme/pulp/n-Octadecenylsuccinate slurry and mixed for another 5 minutes at 120° F. At the end of the treatment, the pulp slurry is quantitatively transferred and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 10M is Made from NSK Pulp that is Modified by the Following Process:

The fibers are treated at approximately 3% starting consistency. Distilled water preheated to 120° F. is first mixed with 15 mL of a 2% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the enzyme reaction period, the pH of the enzyme/pulp slurry is adjusted to approximately 10 with 0.1 normal sodium hydroxide. After pH adjustment, 25 mL of a 6% (wt/vol) solution of n-Dodecenylsuccinate Disodium Salt (preparation described above) is added to the enzyme/pulp slurry to achieve a 5% add-on level (wt active chemical/wt dry fiber basis) and allowed to continue mixing for 30 more minutes at 120° F. After 30 minutes mixing, the pH of the enzyme/pulp/n-Dodecenylsuccinate slurry is adjusted to pH 7 with 1 normal sulfuric acid. After pH adjustment, 2.15 g of zinc chloride (J. T. Baker, Phillipsburg, N.J.) dissolved in 20 mL distilled water is added to the enzyme/pulp/n-Dodecenylsuccinate slurry and mixed for another 5 minutes at 120° F. At the end of the treatment, the pulp slurry is quantitatively transferred and dewatered in a Buchner funnel with filter paper. The resulting modified pulp cake is then diluted to 2,000 mL with tap water and disintegrated for 3,000 revolutions in a TAPPI Standard Desintigrator before handsheet making.

Sample 10N is Made from NSK Pulp that is Modified by the Following Process:

The fibers are treated at approximately 3% starting consistency. Distilled water preheated to 120° F. is first mixed with 15 mL of a 2% Carezyme® solution (1% volume/wt addition of Carezyme® 5.0 L on bone dry pulp) for approximately 15 seconds via a Lightnin'® lab mixer (Lightnin', Rochester, N.Y.) in a 120° F. water bath. The unmodified pulp cake is preheated to approximately 120° F. via a microwave oven and is then added to the enzyme/water mixture. The mixing rate of the Lightnin'® mixer is increased to achieve continuous turn over and agitation of the pulp slurry and allowed to react for approximately 1 hour. At the end of the enzyme reaction period, the pH of the enzyme/pulp slurry is adjusted to approximately 10 with 0.1 normal sodium hydroxide. After pH adjustment, 25 mL of a 6% (wt/vol) solution of n-Dodecenylsuccinate Disodium Salt (preparation described above) is added to the enzyme/pulp slurry to achieve a 5% add-on level (wt active chemical/wt dry fiber basis) and allowed to continue mixing for 30 more minutes at 120° F. After 30 minutes mixing, the pH of the enzyme/pulp/n-Dodecenylsuccinate slurry is adjusted to pH 7 with 1 normal sulfuric acid. After pH adjustment, 1.75 g of calcium chloride (J. T. Baker, Phillipsburg, N.J.) dissolved in 20 mL distilled water is added to the enzyme/pulp/n-Dodecenylsuccinate slurry and mixed for another 5 minutes at 120° F. At the end of the treatment, the pulp slurry is quantitatively transferred and dewatered in a Buchner funnel with filter paper. The resulting modified pulp cake is then diluted to 2,000 mL with tap water and disintegrated for 3,000 revolutions in a TAPPI Standard Desintigrator before handsheet making.

Table 10 gives the results of the dry zero span tensile index, bending modulus/dry tensile ratio, dry tensile and tensile index, caliper, and basis weights of the low density handsheet samples made. It can be seen from the Table that enzyme modification of the fibers with Carezyme® followed by the debonder and salt addition results in substantial reduction of the dry zero span tensile index (DZST) of the NSK fibers while maintaining or improving the overall dry tensile index (DT) of the sheet compared to the handsheet samples produced from unmodified control fibers. In addition, the sheets produced from the modified fibers exhibit substantially reduced bending modulus/dry tensile ratios versus the control sample. The bending modulus/dry tensile ratio average for the handsheets produced from Carezyme® and debonder and enzyme only modified fibers are 564 $cm^{-2}$ and 673 $cm^{-2}$, respectively, which corresponds to an average reduction of 30.5% and 17.1%. These reductions indicate improved flexibility and softness at equal caliper and dry tensile strength with the preferred being the combination of Carezyme® and debonder.

TABLE 10

| Sample (description*) | DZST (N m/g) | Bend. Mod./DT Ratio ($l/cm^2$) | % Bend Mod./DT reduction | DT (g/in) | DT (N m/g) | Caliper (mils) | Basis Wt. (#/3000 $ft^2$) |
|---|---|---|---|---|---|---|---|
| control NSK** | 137.9 | 812 | — | 1043 | 15.3 | 6.9 | 16.3 |
| 10A (0.5% Cz) | 146.2 | 704 | 13.3 | 1061 | 15.4 | 7.9 | 16.4 |
| 10B (1.5% Cz) | 138.6 | 682 | 16.0 | 1016 | 15.0 | 7.6 | 16.2 |
| 10C (0.5% CC) | 140.1 | 701 | 13.7 | 1118 | 16.1 | 7.8 | 16.6 |
| 10D (1.5% CC) | 130.3 | 606 | 25.4 | 1095 | 16.2 | 7.8 | 16.1 |
| 10E (1% Cz, 5% DDS, $CaCl_2$) | 110.6 | 616 | 23.5 | 1169 | 16.8 | 8.0 | 16.6 |
| 10F (1% Cz, 1% DDS, $ZnCl_2$) | 109.2 | 611 | 24.8 | 1390 | 19.2 | 7.8 | 17.3 |
| 10G (1% Cz, 5% DDS, $ZnCl_2$) | 114.8 | 586 | 27.8 | 1226 | 16.5 | 8.1 | 17.8 |
| 10H (1% Cz, 1% ODS, $CaCl_2$) | 113.1 | 524 | 35.5 | 1401 | 19.5 | 8.1 | 17.1 |
| 10I (1% Cz, 5% ODS, $CaCl_2$) | 103.6 | 630 | 22.4 | 1381 | 19.2 | 7.8 | 17.2 |
| 10J (1% Cz, 1% DDS, $CaCl_2$) | 108.2 | 603 | 25.7 | 1344 | 18.5 | 8.2 | 17.3 |
| 10K (1% Cz, 1% ODS, $ZnCl_2$) | 113.0 | 504 | 37.9 | 1539 | 21.0 | 8.1 | 17.5 |
| 10L (1% Cz, 5% ODS, $ZnCl_2$) | 103.5 | 498 | 38.7 | 1446 | 19.9 | 8.3 | 17.4 |
| 10M (1% Cz, 5% DDS, $ZnCl_2$) | 107.6 | 529 | 34.9 | 1443 | 19.9 | 8.1 | 17.3 |
| 10N (1% Cz, 5% DDS, $CaCl_2$) | 109.4 | 541 | 33.4 | 1535 | 21.4 | 8.1 | 17.1 |

*Cz = Carezyme ® 5.0 L
CC = Celluclast ® 1.5 L
DDS = n-Dodecenylsuccinate Disodium Salt
ODS = n-Octadecenylsuccinate Disodium Salt
$ZnCl_2$ = Zinc Chloride
$CaCl_2$ = Calcium Chloride
**Not an example of the present invention.

What is claimed is:

1. Modified cellulosic fibers having a dry zero span tensile index that is at least about 35% less than the dry zero span tensile index and a wet zero span tensile index that is at least about 70% less than the wet zero span tensile index of the corresponding unmodified cellulosic fibers, wherein the fibers are at least partially bleached.

2. The modified cellulosic fibers of claim 1 having a dry zero span tensile index that is at least about 40% less than the dry zero span tensile index of the corresponding unmodified cellulosic fibers.

3. The modified cellulosic fibers of claim 2 having a dry zero span tensile index that is at least about 45% less than the dry zero span tensile index of the corresponding unmodified cellulosic fibers.

4. The modified cellulosic fibers of claim 1 having a dry zero span tensile index that is from about 35% to about 60% less than the dry zero span tensile index of the corresponding unmodified cellulosic fibers.

5. The modified cellulosic fibers of claim 1 wherein the fibers are selected from the group consisting of modified northern, southern and tropical softwood Kraft pulps; modified northern pulps, southern and tropical hardwood Kraft pulps; modified northern, southern and tropical hardwood Sulfite pulps; and modified northern, southern and tropical softwood Sulfite pulps; and mixtures thereof.

6. The modified cellulosic fibers of claim 5 wherein the fibers are selected from the group consisting of modified Northern Softwood Kraft fibers, modified Southern Softwood Kraft fibers, and mixtures thereof.

7. The modified cellulosic fibers of claim 1 wherein the modified fibers are prepared by combining one or more cellulase enzymes and cellulosic fibers, and allowing the combination to react for a period sufficient to reduce the dry zero span tensile index of the fibers by at least about 35%.

8. The modified cellulosic fibers of claim 7 wherein a microorganism which contains or produces one or more cellulase enzymes is combined with the cellulosic fibers.

9. The modified cellulosic fibers of claim 8 wherein one or more enzymes belonging to the family 45 class of cellulases is combined with the cellulosic fibers.

10. The modified cellulosic fibers of claim 9 wherein the one or more enzymes includes the endoglucanase EG V.

11. The modified cellulosic fibers of claim 10 wherein the one or more enzymes includes Carezyme®.

12. The modified cellulosic fibers of claim 7 wherein the one or more cellulase enzymes are selected from the group consisting of Celluclast®, Celluzyme®, Pergolase®, and mixtures thereof.

13. The modified cellulosic fibers of claim 7 wherein the modified fibers are prepared by adding a debonding, agent to the cellulosic fibers, either before, during, or after the fibers have been reacted with the cellulase enzyme.

14. The modified cellulosic fibers of claim 13 wherein the debonding agent is added at a level of at least about 0.1%, on a dry fiber basis.

15. The modified cellulosic fibers of claim 14 wherein the debonding agent is added at a level of at least about 0.3%, on a dry fiber basis.

16. The modified cellulosic fibers of claim 14 wherein the debonding agent is added at a level of from about 0.1 to about 6%, on a dry fiber basis.

17. Modified cellulosic fibers, having a dry zero span tensile index that is at least about 35% less than the dry zero span tensile index of the corresponding unmodified cellulosic fibers and a wet zero span tensile index that is at least about 70% less than the wet zero span tensile index of the corresponding unmodified cellulosic fibers, that exhibit a ratio of dry zero span tensile index to wet zero span tensile index of from about 1.5 to about 3, and wherein the fibers are at least partially bleached.

18. A fibrous structure having a density of not more than about 0.4 g/cc, wherein the fibrous structure comprises modified cellulosic fibers having a dry zero span tensile index that is at least about 35% less than the dry zero span tensile index of the corresponding unmodified cellulosic fibers and a wet zero span tensile index that is at least about 70% less than the wet zero span tensile index of the corresponding unmodified cellulosic fibers, wherein the fibers are at least partially bleached; and wherein the fibrous structure has a bending modulus per unit dry tensile that is at least about 30% less than the bending modulus per unit dry tensile of a fibrous structure prepared from corresponding unmodified fibers.

19. The fibrous structure of claim 18, wherein the fibrous structure has a bending modulus per unit dry tensile that is at least about 35% less than the bending modulus per unit dry tensile of a fibrous structure prepared from corresponding unmodified fibers.

20. The fibrous structure of claim 19, wherein the fibrous structure has a bending modulus per unit dry tensile that is at least about 40% less than the bending modulus per unit dry tensile of a fibrous structure prepared from corresponding unmodified fibers.

21. The fibrous structure of claim 18, wherein the fibrous structure has a bending modulus per unit dry tensile that is from about 30% to about 60% less than the bending modulus per unit dry tensile of a fibrous structure prepared from corresponding unmodified fibers.

22. The fibrous structure of claim 18, wherein the fibrous structure comprises modified cellulosic fibers having a dry zero span tensile index that is at least about 20% less than the dry zero span tensile index of the corresponding unmodified cellulosic fibers.

23. The fibrous structure of claim 22, wherein the fibrous structure comprises modified cellulosic fibers having a dry zero span tensile index that is at least about 25% less than the dry zero span tensile index of the corresponding unmodified cellulosic fibers.

24. The fibrous structure of claim 18 wherein the modified fibers are selected from the group consisting of modified northern, southern and tropical softwood Kraft pulps; modified northern, southern and tropical hardwood Kraft pulps; modified northern, southern and tropical hardwood Sulfite pulps; modified northern, southern and tropical softwood Sulfite pulps; and mixtures thereof.

25. The fibrous structure of claim 18, wherein the fibrous structure comprises modified cellulosic fibers selected from the group consisting of modified Northern Softwood Kraft fibers, modified eucalyptus fibers, modified Northern Hardwood Sulfite fibers, modified Southern Softwood Kraft fibers, and mixtures thereof.

26. The fibrous structure of claim 18, wherein the fibrous structure has a density of from about 0.04 g/cc to about 0.4 g/cc.

27. The fibrous structure of claim 26, wherein the fibrous structure has a density of from about 0.05 g/cc to about 0.3 g/cc.

28. The fibrous structure of claim 18, wherein a handsheet consisting essentially of the modified cellulosic fibers has a dry tensile index that is at least about 90% of the dry tensile index of a corresponding handsheet consisting essentially of the corresponding unmodified cellulosic fibers.

29. The fibrous structure of claim 28, wherein a handsheet consisting essentially of the modified cellulosic fibers has a dry tensile index that is at least about 5% greater than the dry tensile index of a corresponding handsheet consisting essentially of the corresponding unmodified cellulosic fibers.

30. A method for preparing modified cellulosic fibers, the method comprising combining one or more cellulase enzymes and cellulosic fibers, and allowing the combination to react for a period sufficient to reduce the dry zero span tensile index of the fibers by at least about 35% compared with the dry zero span tensile index of the corresponding unmodified cellulosic fibers and to reduce the wet zero span tensile index by at least about 70% compared with the wet zero span tensile index of the corresponding unmodified cellulosic fibers, wherein the fibers are at least partially bleached.

31. The method of claim 30 wherein a microorganism which contains or produces one or more cellulase enzymes is combined with the cellulosic fibers.

32. The method of claim 31, wherein one or more enzymes belonging to the family 45 class of cellulases is combined with the cellulosic fibers.

33. The method of claim 32 wherein the one or more enzymes includes the endoglucanase EG V.

34. The method of claim 31 wherein the one or more cellulase enzymes are selected from the group consisting of Celluclast®, Celluzyme®, Pergolase®, and mixtures thereof.

35. The method of claim 30, wherein the fibers are suspended in water to form a slurry having a consistency of at least about 0.5% by weight.

36. The method of claim 30, wherein the one or more enzymes and the cellulosic fibers are allowed to react for a period sufficient to reduce the dry zero span tensile index of the fibers by at least about 40% compared with the dry zero span tensile index of the corresponding unmodified fibers.

37. A method for preparing modified cellulosic fibers, the method comprising combining one or more cellulase enzymes, cellulosic fibers, and one or more debonding agents, wherein the cellulosic fibers are allowed to react with the one or more cellulase enzymes and the one or more debonding agents for a period sufficient to reduce the dry zero span tensile index of the fibers by at least about 35% compared with the dry zero span tensile index of the corresponding unmodified cellulosic fibers and to reduce the wet zero span tensile index by at least about 70% compared with the wet zero span tensile index of the corresponding unmodified cellulosic fibers, wherein the fibers are at least partially bleached.

38. The method of claim 37 wherein a microorganism which contains or produces one or more cellulase enzymes is combined with the cellulosic fibers.

39. The method of claim 37, wherein the one or more enzymes, the cellulosic fibers and the one or more debonding agents are allowed to react for a period sufficient to reduce the dry zero span tensile index of the fibers by at least about 40% compared with the dry zero span tensile index of the corresponding unmodified fibers.

40. The method of claim 39, wherein the one or more enzymes, the cellulosic fibers and the one or more debonding agents are allowed to react for a period sufficient to reduce the dry zero span tensile index of the fibers by at least about 45% compared with the dry zero span tensile index of the corresponding unmodified fibers.

41. The method of claim 37, wherein the one or more debonding agents is mixed with the cellulosic fibers after the fibers are reacted with the one or more enzymes.

42. The method of claim 37 wherein the one or more debonding agents is combined with the fibers at a level of at least about 0.1%, based on the dry weight of the modified fibers.

43. The method of claim 42 wherein the one or more debonding agents is combined with the fibers at a level of at least about 1%, based on the dry weight of the modified fibers.

44. The method of claim 37 wherein the one or more debonding agents is selected from the group consisting of saturated and unsaturated fatty acids and fatty acid salts; alkenyl succinic anhydrides; alkenyl succinic acids; alkenyl succinate salts; sorbitan mono-, di- and tri-esters; tertiary amines and derivatives thereof; amine oxides; quaternary amines; silicone-based compounds; particulate clays; particulate silicates; and mixtures thereof.

45. The method of claim 37, wherein one or more enzymes belonging to the family 45 class of cellulases is combined with the cellulosic fibers.

46. The method of claim 45 wherein the one or more enzymes includes the endoglucanase EG V.

47. The method of claim 37 wherein the one or more cellulase enzymes are selected from the group consisting of Celluclast®, Celluzyme®, Pergolase®, and mixtures thereof.

48. The method of claim 37, wherein the fibers are suspended in water to form a slurry having a consistency of at least about 0.5% by weight.

49. The method of claim 37, wherein a solution comprising the one or more enzymes is formed prior to combining the enzyme(s) with the cellulosic fibers.

50. A method for preparing a fibrous structure having a density of not more than about 0.4 g/cc, wherein the fibrous structure comprises modified cellulosic fibers and wherein the fibrous structure has a bending modulus per unit dry tensile that is at least about 30% less than the bending modulus per unit dry tensile of a fibrous structure prepared from corresponding unmodified fibers, the method comprising the steps of:

i. creating the modified fibers by combining one or more cellulase enzymes, cellulosic fibers, and one or more debonding agents, wherein the cellulosic fibers are allowed to react with the one or more cellulase enzymes and the one or more debonding agents for a period sufficient to reduce the dry zero span tensile index of the fibers by at least about 35% index compared with the dry zero span tensile index of the corresponding unmodified cellulosic fibers and to reduce the wet zero span tensile index by at least about 70% compared with the wet zero span tensile index of the corresponding unmodified cellulosic fibers, wherein the fibers are at least partially bleached; and ii. forming the fibrous structure from the modified fibers.

51. The method of claim 50, wherein the fibrous structure has a bending modulus per unit dry tensile that is at least about 35% less than the bending modulus per unit dry tensile of a fibrous structure prepared from corresponding unmodified fibers.

52. The method of claim 51, wherein the fibrous structure has a bending modulus per unit dry tensile that is at least about 40% less than the bending modulus per unit dry tensile of a fibrous structure prepared from corresponding unmodified fibers.

53. The method of claim 50, wherein the fibrous structure has a bending modulus per unit dry tensile that is from about 30% to about 60% less than the bending modulus per unit dry tensile of a fibrous structure prepared from corresponding unmodified fibers.

54. The method of claim 50, wherein the cellulosic fibers are allowed to react with the one or more cellulase enzymes and the one or more debonding agents for a period sufficient to reduce the dry zero span tensile index of the fibers by at least about 20% compared with the dry zero span tensile index of the corresponding unmodified fibers.

55. The method of claim 54, wherein the cellulosic fibers are allowed to react with the one or more cellulase enzymes and the one or more debonding agents for a period sufficient to reduce the dry zero span tensile index of the fibers by at least about 25% compared with the dry zero span tensile index of the corresponding unmodified fibers.

56. The method of claim 54 wherein the fibers are selected from the group consisting of modified northern, southern and tropical softwood Kraft pulps; modified northern, southern and tropical hardwood Kraft pulps; modified northern, southern and tropical hardwood Sulfite pulps; modified northern, southern and tropical softwood Sulfite pulps; and mixtures thereof.

57. The method of claim 50 wherein the one or more debonding agents is combined with the fibers at a level of at least about 0.1%, based on the dry weight of the modified fibers.

58. The method of claim 57 wherein the one or more debonding agents is combined with the fibers at a level of at least about 1%, based on the dry weight of the modified fibers.

59. The method of claim 50 wherein the one or more debonding agents is selected from the group consisting of saturated and unsaturated fatty acids and fatty acid salts; alkenyl succinic anhydrides; alkenyl succinic acids; alkenyl succinate salts; sorbitan mono-, di- and tri-esters, including stearates, palmitates, oleates, myristates, behenates; tertiary amines and derivatives thereof; amine oxides; quaternary amines; silicone-based compounds; particulate clays; particulate silicates; and mixtures thereof.

60. The method of claim 50, wherein one or more enzymes belonging to the family 45 class of cellulases is combined with the cellulosic fibers.

61. The method of claim 60 wherein the one or more enzymes includes the endoglucanase EG V.

62. The method of claim 50 wherein the one or more cellulase enzymes are selected from the group consisting of Celluclast®, Celluzyme®, Pergolase®, and mixtures thereof.

63. The method of claim 50, wherein the fibers are suspended in water to form a slurry having a consistency of at least about 0.5% by weight.

64. The method of claim 50, wherein a solution comprising the one or more enzymes is formed prior to combining the enzyme(s) with the cellulosic fibers.

* * * * *

UNITED STATES PATENT AND TRADEMARK OFFICE

CERTIFICATE OF CORRECTION

PATENT NO. : 6,146,494
DATED : November 14, 2000
INVENTOR(S) : Geoffrey E. Seger et al.

It is certified that error appears in the above-identified patent and that said Letters Patent is hereby corrected as shown below:

Column 7,
Line 28, "krzemieniewskoe" should read -- krzemienlewskoe --.

Column 8,
Line 39, "hemicellulascs" should read -- hemicellulases --.

Column 10,
Line 30, "Emanuclsson" should read -- Emanuelsson --.

Column 23,
Line 20, "fuinnel" should read -- funnel --.

Column 45,
Line 10, "." should read -- , --.

Signed and Sealed this

Eighteenth Day of June, 2002

*Attest:*

*Attesting Officer*

JAMES E. ROGAN
*Director of the United States Patent and Trademark Office*